US009801260B2

(12) United States Patent
Anthony et al.

(10) Patent No.: US 9,801,260 B2
(45) Date of Patent: Oct. 24, 2017

(54) TECHNIQUES AND GRAPHICAL USER INTERFACE FOR CONTROLLING SOLID-STATE LUMINAIRE WITH ELECTRONICALLY ADJUSTABLE LIGHT BEAM DISTRIBUTION

(71) Applicants: Mervyn Anthony, Waltham, MA (US); Michael Quilici, Essex, MA (US); Seung Cheol Ryu, Marblehead, MA (US); Jeff Holt, Concord, NH (US)

(72) Inventors: Mervyn Anthony, Waltham, MA (US); Michael Quilici, Essex, MA (US); Seung Cheol Ryu, Marblehead, MA (US); Jeff Holt, Concord, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 4 days.

(21) Appl. No.: 14/221,589

(22) Filed: Mar. 21, 2014

(65) Prior Publication Data

US 2015/0084513 A1 Mar. 26, 2015

Related U.S. Application Data

(63) Continuation-in-part of application No. 14/032,821, filed on Sep. 20, 2013, which is a continuation-in-part of application No. 14/032,856, filed on Sep. 20, 2013.

(51) Int. Cl.
*H05B 33/08* (2006.01)
*H05B 37/02* (2006.01)

(52) U.S. Cl.
CPC ..... *H05B 37/0245* (2013.01); *H05B 33/0863* (2013.01); *H05B 37/029* (2013.01)

(58) Field of Classification Search
None
See application file for complete search history.

(56) References Cited

U.S. PATENT DOCUMENTS 6,392,368 B1 5/2002 Deller et al.
9,268,407 B1 * 2/2016 Noble ..... G06F 3/0488
(Continued)

FOREIGN PATENT DOCUMENTS

KR 20090000762 1/2009
WO 2007125520 A1 11/2007

OTHER PUBLICATIONS

ArtNet DMX Over Ethernet Network and WIFI, webpage www.lightjams.com/artnet.html dated Jan. 7, 2014.
(Continued)

*Primary Examiner* — Crystal L Hammond
(74) *Attorney, Agent, or Firm* — Yutian Ling

(57) ABSTRACT

Techniques and user interfaces (UIs) are disclosed for controlling a solid-state luminaire having an electronically adjustable light beam distribution. The disclosed UI may be configured, in accordance with some embodiments, to provide a user with the ability to control, by wireless and/or wired connection, the light distribution of an associated solid-state luminaire in a given space. The UI may be hosted by any computing device, portable or otherwise, and may be used to control any given light distribution capability provided by a paired luminaire. In accordance with some embodiments, the user may provide such control without need to know details about the luminaire, such as the quantity of solid-state lamps, or their individual addresses, or the address of the fixture itself. In some cases, the disclosed techniques may involve acquiring spatial information of the space that hosts the luminaire and/or providing user-selected distribution of light within that space.

22 Claims, 15 Drawing Sheets

(56) References Cited

U.S. PATENT DOCUMENTS 9,426,865 B2 * 8/2016 Liu ..... H05B 37/0227
2005/0248299 A1 * 11/2005 Chemel ..... H05B 37/029 315/312
2006/0007123 A1 * 1/2006 Wilson ..... G06F 3/0425 345/156
2006/0022214 A1 * 2/2006 Morgan ..... F21K 9/00 257/99
2006/0170376 A1 * 8/2006 Piepgras ..... E06B 3/6722 315/295
2006/0250377 A1 * 11/2006 Zadesky ..... G06F 1/1613 345/173
2009/0243957 A1 * 10/2009 Ni ..... G06F 3/04815 345/1.1
2010/0046226 A1 2/2010 Cox et al.
2010/0270933 A1 * 10/2010 Chemel ..... H05B 37/029 315/130
2010/0295797 A1 * 11/2010 Nicholson ..... G06F 1/1626 345/173
2011/0001436 A1 * 1/2011 Chemel ..... H05B 37/029 315/291
2011/0025598 A1 * 2/2011 Underkoffler ..... G06F 3/017 345/156
2011/0051420 A1 3/2011 Gill
2011/0112691 A1 * 5/2011 Engelen ..... H05B 37/029 700/275
2011/0199004 A1 * 8/2011 Henig ..... H05B 37/0218 315/152
2011/0221678 A1 * 9/2011 Davydov ..... G06F 3/0486 345/168
2011/0242138 A1 * 10/2011 Tribble ..... G06F 3/04886 345/663
2011/0273114 A1 * 11/2011 Ogg ..... H05B 37/029 315/312
2012/0113640 A1 5/2012 Markle et al.
2012/0206050 A1 * 8/2012 Spero ..... B60Q 1/04 315/152
2012/0206918 A1 8/2012 Lee et al.
2013/0120248 A1 * 5/2013 Gilra ..... G06F 3/04812 345/157
2013/0271004 A1 * 10/2013 Min ..... H05B 33/0842 315/112
2013/0293112 A1 * 11/2013 Reed ..... H05B 37/0272 315/131
2014/0070706 A1 * 3/2014 Fushimi ..... H05B 33/0863 315/131
2014/0232273 A1 * 8/2014 Sasaki ..... G06F 3/04817 315/131
2014/0321135 A1 * 10/2014 Chen ..... F21K 9/58 362/487
2016/0120009 A1 * 4/2016 Aliakseyeu ..... H05B 37/0272 315/131
2016/0227635 A1 * 8/2016 Aliakseyeu ..... H05B 33/0863

OTHER PUBLICATIONS

Prouteau, Evelyne, International Search Report and Written Opinion of the International Search Authority for PCT/US2015/058537, dated Jan. 11, 2016, European Patent Office, Rijswijk, The Netherlands (12 pages).

* cited by examiner

TECHNIQUES AND GRAPHICAL USER INTERFACE FOR CONTROLLING SOLID-STATE LUMINAIRE WITH ELECTRONICALLY ADJUSTABLE LIGHT BEAM DISTRIBUTION

CROSS-REFERENCE TO RELATED APPLICATIONS

This Application is related to U.S. patent application Ser. No. 14/221,638 , filed on Mar. 21, 2014, U.S. patent application Ser. No. 14/032,821, filed on Sep. 20, 2013, and U.S. patent application Ser. No. 14/032,856, filed on Sep. 20, 2013, each of which is herein incorporated by reference in its entirety.

FIELD OF THE DISCLOSURE

The present disclosure relates to solid-state lighting (SSL) fixtures and more particularly to light-emitting diode (LED)-based luminaires.

BACKGROUND

Traditional adjustable lighting fixtures, such as those utilized in theatrical lighting, employ mechanically adjustable lenses, track heads, gimbal mounts, and other mechanical parts to adjust the angle and direction of the light output thereof. Mechanical adjustment of these components is normally provided by actuators, motors, or manual adjustment by a lighting technician. Also, existing lighting fixtures that utilize digital multiplexer (DMX) interfaces to physically control light distribution require entry into that adapter of the address of each individual light-emitting diode (LED) that is to be turned on or off.

Figure 1A:
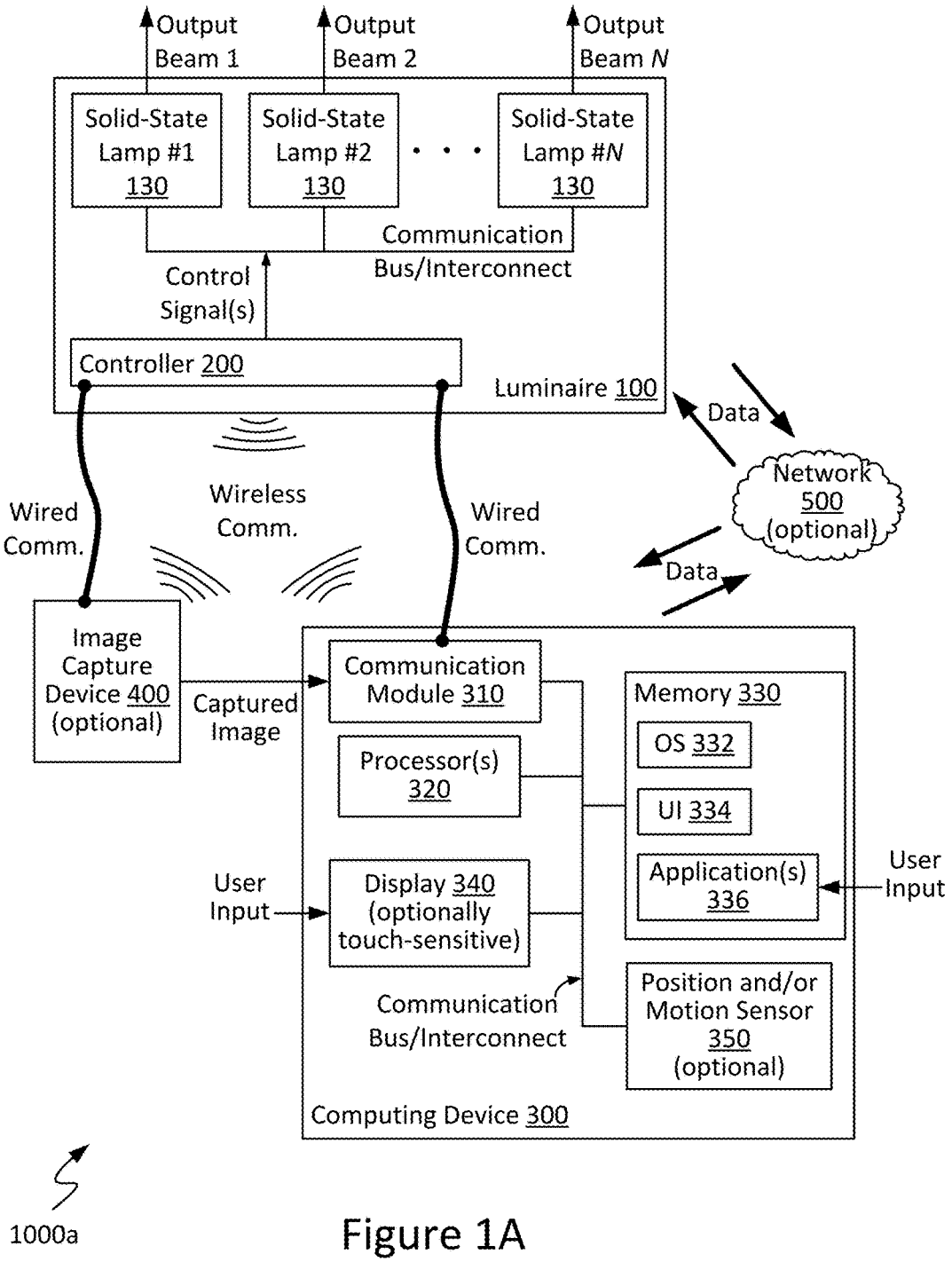
FIG. 1A is a block diagram of a lighting system configured in accordance with an embodiment of the present disclosure

These and other features of the present embodiments will be understood better by reading the following detailed description, taken together with the figures herein described. The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

Techniques and user interfaces (UIs) are disclosed for controlling a solid-state luminaire having an electronically adjustable light beam distribution. The disclosed UI may be configured, in accordance with some embodiments, to provide a user with the ability to control, by wireless and/or wired connection, the light distribution of an associated solid-state luminaire in a given space. The UI may be hosted by any computing device, portable or otherwise, and may be used to control any given light distribution capability provided by a paired luminaire. In accordance with some embodiments, the user may provide such control without need to know details about the luminaire, such as the quantity of solid-state lamps, or their individual addresses, or the address of the fixture itself. In some cases, the disclosed techniques may involve acquiring spatial information of the space that hosts the luminaire and/or providing user-selected distribution of light within that space. Numerous configurations and variations will be apparent in light of this disclosure.

General Overview

As previously noted, existing lighting designs rely upon mechanical movements for adjusting light distribution. However, these designs generally include relatively large components, such as those used in theater lighting. Also, the cost of such systems is normally high given the complexity of the mechanical equipment required to provide the desired degree of adjustability and given that lighting technicians are normally required to mechanically operate such systems. Furthermore, there is a safety concern associated with the need to manually adjust, repair, and replace components of these types of systems, particularly in areas which are normally out-of-reach without the use of a ladder, scaffolding, or aerial work platform, for example.

Thus, and in accordance with some embodiments of the present disclosure, techniques and user interfaces (UIs) are disclosed for controlling a solid-state luminaire having an electronically adjustable light beam distribution. The disclosed UI design logic may be configured, in accordance with some embodiments, to provide a user with the ability to control, by wireless and/or wired connection, the light distribution of an associated solid-state luminaire in a given space. The disclosed UI application may be installed on any computing device, portable or otherwise, and may be used to control one or more light distribution capabilities provided by a given solid-state luminaire. In accordance with some embodiments, the user may provide such control without need to know details about the associated luminaire, such as the quantity of solid-state lamps, or their individual addresses, or the address of the fixture itself. In some cases, the disclosed control techniques may involve acquiring spatial information of the space (e.g., room, office, etc.) that hosts the target luminaire and/or providing user-selected distribution of light within that space. In some cases, the disclosed UI application may be configured to discover the presence of multiple luminaires in a given space and prompt the user to select which luminaire(s) are to be controlled. As discussed herein, in some embodiments, the UI may be presented as a graphical UI (GUI), while in some other embodiments, the UI may be presented as a photographical UI.

It should be noted that while the disclosed techniques and UIs (e.g., graphical UI; photographical UI) generally are discussed in the example context of portable computing devices, the present disclosure is not so limited. For instance, in some cases, the disclosed techniques can be used, for example, with non-mobile computing devices (e.g., a desktop computer, a television, etc.), in accordance with some embodiments. Numerous suitable host platforms will be apparent in light of this disclosure.

System Architecture and Operation

Figure 1B:
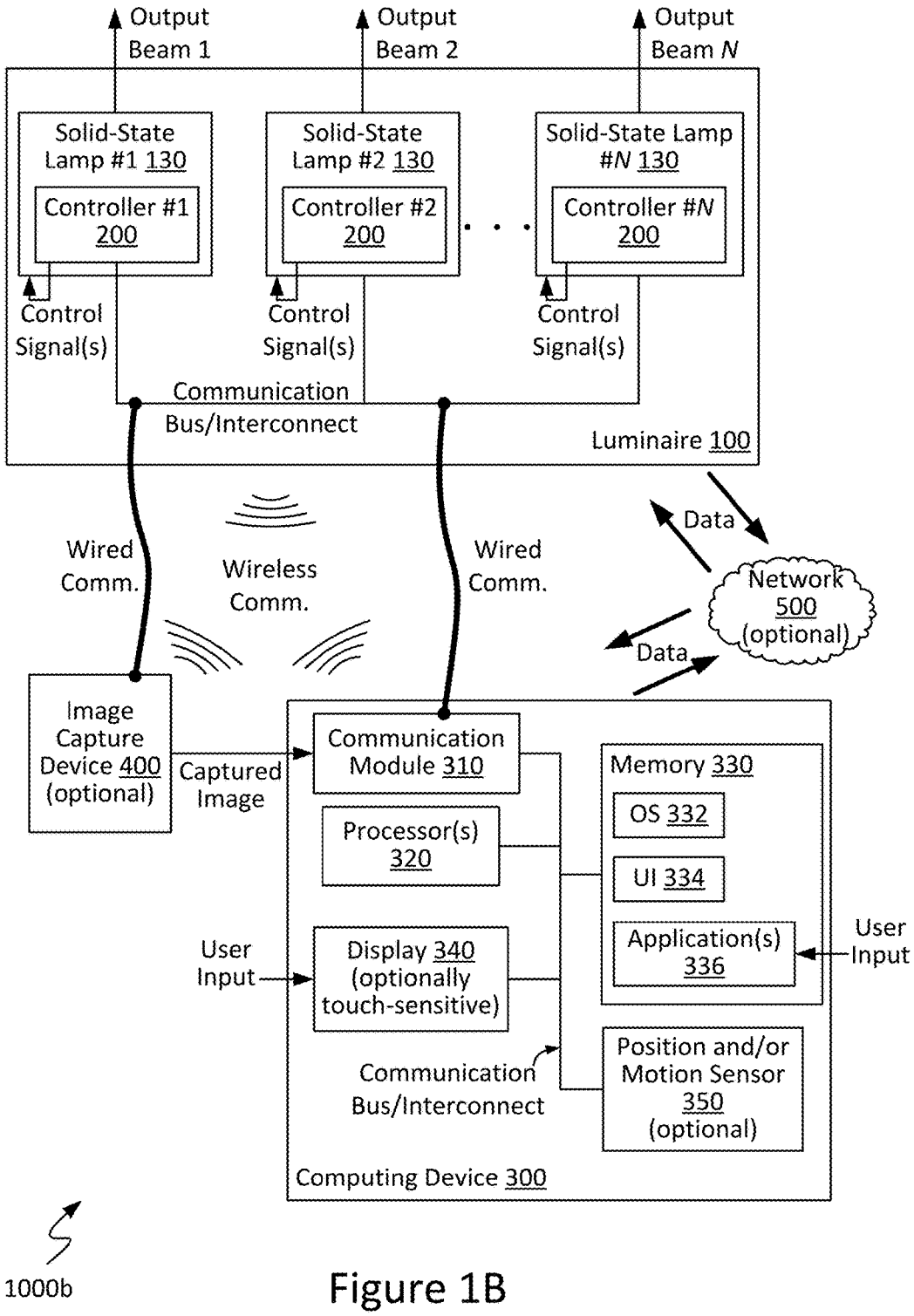
FIG. 1B is a block diagram of a lighting system configured in accordance with another embodiment of the present disclosure.

FIG. 1A is a block diagram of a lighting system 1000*a* configured in accordance with an embodiment of the present disclosure, and FIG. 1B is a block diagram of a lighting system 1000*b* configured in accordance with another embodiment of the present disclosure. As can be seen, system 1000*a*/1000*b* may include: a luminaire 100; one or more controllers 200 operatively coupled with luminaire 100; and a computing device 300 communicatively coupled with luminaire 100. As described herein, computing device 300 may be utilized, in accordance with some embodiments, to control the light output of luminaire 100 (e.g., to customize the light distribution for a given space or surface of incidence). Also, in some cases, system 1000*a*/1000*b* optionally may include an image capture device 400 configured, for example, to capture image data of a given space or surface of incidence to be lighted using luminaire 100. A discussion of these is provided below.

In some instances, computing device 300 may be configured to be directly communicatively coupled with luminaire 100, as described herein. In some other cases, however, device 300 and luminaire 100 optionally may be indirectly communicatively coupled with one another, for example, by an intervening or otherwise intermediate network 500 for facilitating the transfer of data between device 300 and luminaire 100. Network 500 may be any suitable communications network, and in some example cases may be a public and/or private network, such as a private local area network (LAN) operatively coupled to a wide area network (WAN) such as the Internet. In some instances, network 500 may include a wireless local area network (WLAN) (e.g., Wi-Fi® wireless data communication technologies). In some instances, network 500 may include Bluetooth® wireless data communication technologies. In some cases, network 500 may include supporting infrastructure and/or functionalities such as a server and a service provider, but such features are not necessary to carry out communication via network 500.

Figure 2A:
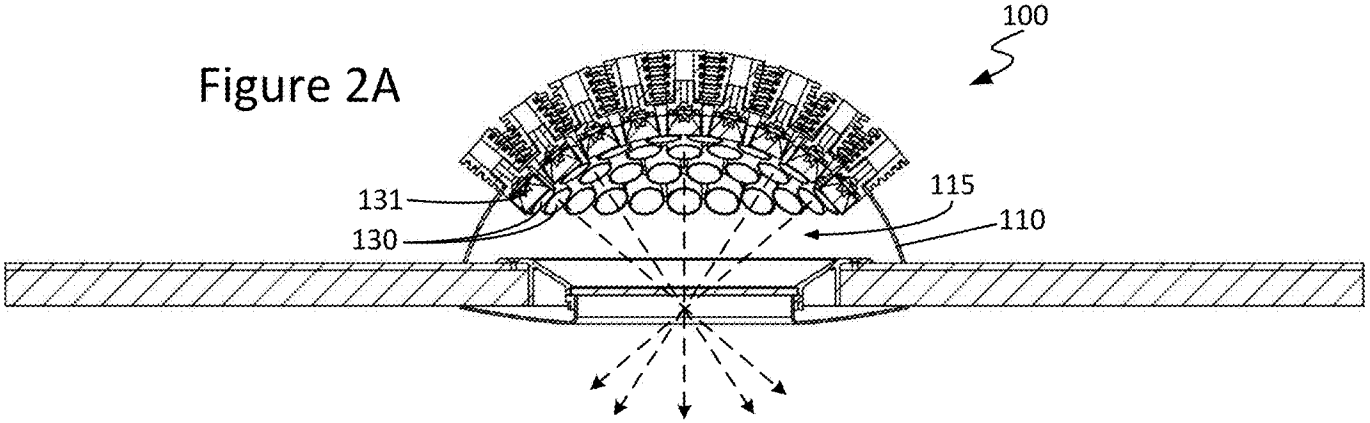
FIG. 2A is a cross-sectional view of a luminaire configured in accordance with an embodiment of the present disclosure.
Figure 2B:
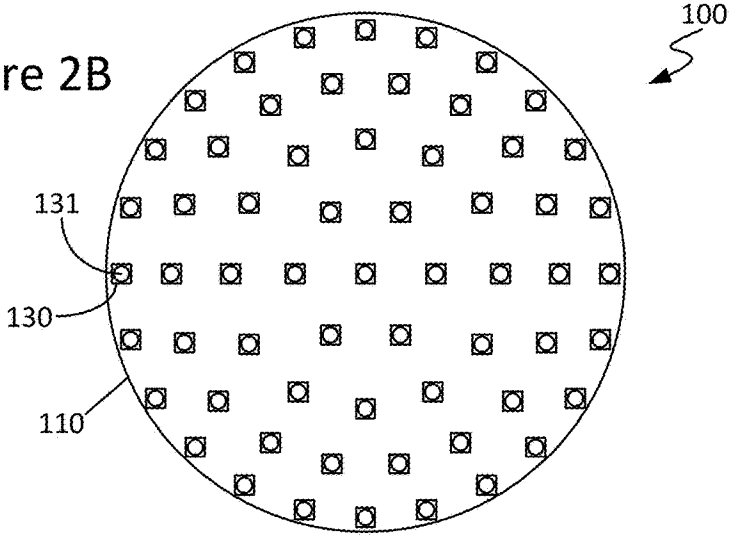
FIG. 2B is a plan view of a luminaire configured in accordance with an embodiment of the present disclosure.

Luminaire 100 can have any of a wide range of configurations. For example, consider FIGS. 2A-2B, which are cross-sectional and plan views, respectively, of a luminaire 100 configured in accordance with an embodiment of the present disclosure. As can be seen, luminaire 100 may include a housing 110 and a plurality of solid-state lamps 130 arranged within the plenum 115 of housing 110. In accordance with some embodiments, luminaire 100 may be configured, for example, as described in U.S. patent application Ser. No. 14/032,821, titled "Solid-State Luminaire with Electronically Adjustable Light Beam Distribution." Each lamp 130 may include one or more solid-state emitters 131 (e.g., light-emitting diodes, or LEDs) and tunable electro-optic componentry configured to provide that lamp 130 with its own electronically adjustable light beam, in accordance with some embodiments. Lamps 130 can be electronically controlled individually and/or in conjunction with one another, for example, to provide highly adjustable light emissions from the luminaire 100 (e.g., digitally addressable, pixelated control over light distribution), in accordance with some embodiments. Other suitable configurations for luminaire 100 will depend on a given application and will be apparent in light of this disclosure.

As previously noted, the solid-state lamps 130 of luminaire 100 can be electronically controlled individually and/or in conjunction with one another, for example, to provide highly adjustable light emissions from the luminaire 100. To that end, luminaire 100 may include or otherwise be communicatively coupled with one or more controllers 200 which can be used to electronically control the output of the emitters 131 individually and/or in conjunction with one another (e.g., as an array or partial array), thereby electronically controlling the light output of luminaire 100 as a whole.

In accordance with some embodiments, a given controller 200 may be responsible for translating received inputs (e.g., directly and/or indirectly received from computing device 300) to control one or more of the solid-state lamps 130 of luminaire 100 to obtain a given desired light distribution. In some cases, a given controller 200 may be configured to provide for electronic adjustment, for example, of the beam direction, beam angle, beam distribution, and/or beam diameter for each lamp or some sub-set of the available lamps 130 of luminaire 100, thereby allowing for customizing the spot size, position, and/or distribution of light in a given space or on a given surface of incidence. In some cases, controller 200 may provide for electronic adjustment, for example, of the brightness (dimming) and/or color of light, thereby allowing for dimming and/or color mixing/tuning, as desired.

FIG. 1A is a block diagram of a lighting system 1000*a* configured in accordance with an embodiment of the present disclosure. Here, a controller 200 is operatively coupled (e.g., by a communication bus/interconnect) with the solid-state lamps 130 1-N of luminaire 100. In this example case, controller 200 may output a control signal to any one or more of the solid-state lamps 130 and may do so, for example, based on wired and/or wireless input received from computing device 300, discussed below. As a result, luminaire 100 may be controlled in such a manner as to output any number of output beams 1-N, which may be varied in beam direction, beam angle, beam size, beam distribution, brightness/dimness, and/or color, as desired for a given target application or end-use, in accordance with some embodiments.

However, the present disclosure is not so limited. For instance, consider FIG. 1B, which is a block diagram of a lighting system 1000*b* configured in accordance with another embodiment of the present disclosure. Here, each solid-state lamp 130 1-N of luminaire 100 includes its own controller 200. In a sense, each solid-state lamp 130 may be considered as effectively having its own mini-controller, thus providing luminaire 100 with a distributed controller 200. In some instances, the controller 200 of a given solid-state lamp 130 may be populated, for example, on a printed circuit board (PCB) associated with that lamp 130. In this example case, a given controller 200 may output a control signal to an associated solid-state lamp 130 of luminaire 100 and may do so, for example, based on wired and/or wireless input received from computing device 300, discussed below. As a result, luminaire 100 may be controlled in such a manner as to output any number of output beams 1-N, which may be varied in beam direction, beam angle, beam size, beam distribution, brightness/dimness, and/or color, as desired for a given target application or end-use, in accordance with some embodiments.

A given controller 200 may utilize any of a wide variety of digital communications protocol, such as, for example, a digital multiplexer (DMX) interface, a Wi-Fi™ protocol, a Bluetooth® protocol, a digital addressable lighting interface (DALI) protocol, a ZigBee protocol, or any other suitable communications protocol, wired and/or wireless, as will be apparent in light of this disclosure. In some cases, a given controller 200 may be configured as a terminal block or other pass-through such that computing device 300 is effectively coupled directly with the individual solid-state emitters 131 of luminaire 100. Numerous suitable configurations will be apparent in light of this disclosure.

As discussed herein, control of the emission of luminaire 100 may be provided, for example, by a wired and/or wireless control interface provided by computing device 300, which may be a touch-sensitive electronic device, in some cases. In some embodiments, device 300 may include a touch-sensitive display 340 configured to provide a touch-based graphical user interface (GUI) 370 that may be utilized to control the solid-state emitters 131 of the solid-state lamps 130 of luminaire 100 individually and/or in conjunction with one another, as described herein. In some instances, the touch-sensitive interface may be operatively coupled with the one or more controllers 200, which in turn interpret the input from computing device 300 and provide the desired control signal(s) to one or more of the solid-state emitters 131 of luminaire 100. In some other instances, the touch-sensitive interface may be operatively coupled directly with the solid-state emitters 131 to control them directly.

Computing device 300 may be any portable/mobile or non-mobile electronic device configured for wired and/or wireless communication. In some instances, device 300 may include or otherwise be configured to communicate with a display 340 that is touch-sensitive, as discussed below. Some example suitable devices 300 may include, in part or in whole: (1) a laptop/notebook computer; (2) a tablet computer; (3) a mobile phone or smartphone (e.g., iPhone®, Android®-based phone, Blackberry®, Symbian®-based phone, Palm®-based phone, etc.); (4) a personal digital assistant (PDA); (5) a portable media player (PMP); (6) a cellular handset; (7) a handheld gaming device; (8) a gaming platform/console; (9) a desktop computing system; and/or (10) a television or other electronic visual display. Also, as discussed herein, computing device 300 may include any of a wide range of modules/components, as desired for a given target application or end-use. In accordance with some embodiments, computing device 300 may be configured for communication between any or all its modules/components, and in some cases, device 300 may include a communications bus/interconnect to that end. It should be noted, however, that the present disclosure is not intended to be limited in form or function to the example device 300 depicted in the figures, and numerous other suitable configurations for device 300 will be apparent in light of this disclosure.

As can be seen in FIGS. 1A-1B, device 300 may include a communication module 310, in accordance with some embodiments. Communication module 310 may be configured, for example, to aid in communicatively coupling device 300 with: (1) luminaire 100 (e.g., the one or more controllers 200 thereof); (2) image capture device 400 (if optionally included); and/or (3) network 500, if desired. To that end, communication module 310 can be configured, for example, to execute any suitable wireless communication protocol that allows for data/information to be passed wirelessly. Note that each of computing device 300, luminaire 100, and optional image capture device 400 can be associated with a unique ID (e.g., IP address, MAC address, cell number, or other such identifier) that can be used to assist the communicative coupling there between, in accordance with some embodiments. Some example suitable wireless communication methods that can be implemented by communication module 310 of device 300 may include: radio frequency (RF) communications (e.g., Wi-Fi®; Bluetooth®; near field communication or NFC); IEEE 802.11 wireless local area network (WLAN) communications; infrared (IR) communications; cellular data service communications; satellite Internet access communications; custom/proprietary communication protocol; and/or a combination of any one or more thereof. In some embodiments, device 300 may be capable of utilizing multiple methods of wireless communication. In some such cases, the multiple wireless communication techniques may be permitted to overlap in function/operation, while in some other cases they may be exclusive of one another.

It should be noted, however, that the present disclosure is not limited only to wireless communication, as in some cases a wired connection (e.g., USB, Ethernet, FireWire, or other suitable wired interfacing) may be provided between device 300 and: (1) luminaire 100 (e.g., the one or more controllers 200 thereof); and/or (2) image capture device 400, if optionally included. In a more general sense, communication module 310 may be configured such that device 300 is able to transmit and/or receive information with respect to any given source/recipient, by wired and/or wireless connection, using any suitable protocol (e.g., LAN-based, Internet-based, cellular-based, satellite-based, or any combination thereof), as desired for a given target application or end-use. Other suitable configurations and componentry (e.g., receiver, transmitter, transceiver) which may provide the desired wired/wireless communication between computing device 300 and a paired luminaire 100 and/or image capture device 400 (including any custom or proprietary protocols) will depend on a given application and will be apparent in light of this disclosure.

In accordance with some embodiments, device 300 may include one or more processors 320 configured, for example, to perform operations associated with device 300 and any one or more of the modules/components included therein. For instance, a given processor 320 may be configured, in some embodiments, to process or otherwise interpret data that is: (1) input from a user (e.g., using a touch-sensitive display 340 and/or application 336 stored in memory 330); (2) input from an image capture device 400 (if optionally included); and/or (3) output to be received by luminaire 100. Other suitable configurations of the one or more processors 320 of device 300 will depend on a given application and will be apparent in light of this disclosure.

In accordance with some embodiments, device 300 may include a memory 330. Memory 330 can be of any suitable type (e.g., RAM and/or ROM, or other suitable memory) and size, and in some cases may be implemented with volatile memory, non-volatile memory, or a combination thereof. Memory 330 may be utilized, for example, for processor workspace and/or to store media, programs, applications, content, etc., on device 300 on a temporary or permanent basis. Also, memory 330 can include one or more modules stored therein that can be accessed and executed, for example, by processor(s) 320.

For instance, memory 330 may include an operating system (OS) module 332 configured, in accordance with some embodiments, to aid in processing: (1) user input (e.g., received from display 340 and/or an application 336 stored in memory 330); and/or (2) captured image data received from optional image capture device 400. OS module 332 can be implemented with any suitable OS, mobile or otherwise, such as: Android® OS from Google, Inc.; iOS® from Apple, Inc.; Windows Phone® OS from Microsoft Corp.; BlackBerry® OS from BlackBerry Ltd.; Symbian OS; Palm® OS from Palm, Inc. Other suitable types and configurations for OS module 332 will depend on a given application and will be apparent in light of this disclosure.

In accordance with some embodiments, memory 330 may include a user interface (UI) module 334 configured, for example, to provide a graphical user interface (GUI) 370 (discussed below) using display 340 (e.g., which may be touch-sensitive, in some instances). UI module 334 can be programmed or otherwise configured to provide a GUI 370 as variously described herein, such as with reference to the example screenshots of FIGS. 3A, 3B, 4A, 5A, 6A, 7B, and 7C and/or the methodologies demonstrated in FIGS. 4C, 5C, and 6C, which will be discussed in turn. To that end, UI module 334 may include custom, proprietary, known, and/or after-developed user interface construction code (or instruction sets) that are generally well-defined and operable to present one or more control features via GUI 370 for selection and/or manipulation (e.g., by a user). It should be noted, however, that UI module 334 need not be implemented only in memory 330 (e.g., as generally shown in FIGS. 1A-1B), as in some other embodiments, UI module 334 can be implemented in a combination of locations (e.g., memory 330, display 340, etc.), thereby providing the UI module 334 with a degree of functional distributedness. Other suitable configurations for UI module 334 will depend on a given application and will be apparent in light of this disclosure.

Memory 330 also may include one or more applications 336 stored therein. For example, in some cases, memory 330 may include or otherwise have access to an image/video recording application or other software that permits image capturing/video recording using optional image capture device 400, as described herein. In some cases, memory 330 may include or otherwise have access to an image/video playback application or other software that permits playback/viewing of images/video captured using optional image capture device 400 or other content. In some embodiments, one or more applications 336 may be included to facilitate presentation and/or operation of GUI 370. Other suitable applications 330 to be hosted/accessed by device 300 will depend on a given application and will be apparent in light of this disclosure.

A given module of memory 330 can be implemented in any suitable programming language, such as, for example: C; C++; objective C; JavaScript; custom or proprietary instruction sets; etc. The modules of device 300 can be encoded, for example, on a machine-readable medium that, when executed by a processor (e.g., such as the one or more processors 320), carries out the desired functionality of that portion of device 300. The computer-readable medium may be, for example, a hard drive, compact disk, memory stick, server, or any suitable non-transitory computer/computing device memory that includes executable instructions, or a plurality or combination of such memories. Other embodiments can be implemented, for instance, with gate-level logic or an application-specific integrated circuit (ASIC) or chip set or other such purpose-built logic. Some embodiments can be implemented with a microcontroller having input/output capability (e.g., inputs for receiving user inputs; outputs for directing other components) and a number of embedded routines for carrying out a given desired functionality. In a more general sense, the functional modules of device 300 can be implemented in hardware, software, and/or firmware, as desired. Other suitable modules/components for memory 330 will depend on a given application and will be apparent in light of this disclosure.

The display 340 of device 300 may utilize any display technology suitable, for example, for the display of images, video, text, or other desired content. As previously noted, display 340 optionally may be touch-sensitive (e.g., to assist with the function of UI module 334, as discussed above), in some embodiments. To that end, display 340 may utilize any of a wide range of touch-sensing techniques, such as, for example: resistive touch-sensing; capacitive touch-sensing; surface acoustic wave (SAW) touch-sensing; infrared (IR) touch-sensing; optical imaging touch-sensing; and/or any combination thereof. In a more general sense, and in accordance with some embodiments, touch-sensitive display 340 generally may be configured to detect or otherwise sense direct and/or proximate contact from a user's finger, stylus, or other suitable implement at a given location of display 340. In some cases, display 340 may be configured to translate such contact into an electronic signal that can be processed by device 300 (e.g., by the one or more processors 320 thereof) and manipulated or otherwise used to trigger a GUI 370 action, such as any of those discussed herein.

Touch-sensitive display 340 may permit provision of a GUI 370 including one or more control features (discussed below) which may be utilized, in accordance with some embodiments, to provide input to computing device 300 to be relayed to: (1) the one or more controllers 200 of luminaire 100; and/or (2) image capture device 400, if included. In some cases, display 340 may be integrated with computing device 300, while in some other case, display 340 may be a stand-alone component configured to communicate with device 300 using any suitable wired and/or wireless communications techniques. Other suitable configurations and touch-sensitive capabilities for display 340 will depend on a given application and will be apparent in light of this disclosure.

It should be noted, however, that the present disclosure is not so limited, as in some other embodiments, device 300 may include or otherwise be operatively coupled with a non-touch-sensitive display 340 and have a touch-sensitive surface implemented therewith (e.g., a touch-sensitive track pad). In some such cases, device 300 generally may be capable of translating direct and/or proximate contact of the touch-sensitive surface into an electronic signal that can be processed by device 300 (e.g., by the one or more processors 320 thereof) and manipulated or otherwise used to trigger a GUI 370 action, such as any of those discussed herein.

In some embodiments, device 300 optionally may include a position and/or motion sensor 350 configured, for example, to aid in determining the orientation and/or movement of computing device 300 with respect to a given point of reference (e.g., a luminaire 100). When included, position and/or motion sensor 350 may be configured as traditionally done and, in accordance with some embodiments, may be communicatively coupled with orientation indicator feature 352, discussed below. In some instances, position and/or motion sensor 350 may be configured, for example, with geomagnetic sensing capabilities to aid in determining the orientation and/or movement of computing device 300 with respect to a geomagnetic pole (e.g., geomagnetic north). Numerous configurations will be apparent in light of this disclosure.

As previously noted, device 300 may be configured, in accordance with some embodiments, to display or otherwise provide a graphical user interface (GUI) 370. For example, consider FIGS. 3A and 3B, which illustrate example screenshots of a computing device 300 on which a GUI 370 is displayed, in accordance with some embodiments of the present disclosure. As can be seen, display 340 can be configured to display various GUI 370 menus, sub-menus, features, icons (e.g., light-based icons), and/or buttons (e.g., virtual buttons), hereinafter referred to as GUI control features, that a user may utilize in controlling the performance/behavior of device 300, luminaire 100, and/or optional image capture device 400.

In accordance with some embodiments, GUI 370 may be configured to allow selection from the one or more modules and/or applications stored within device 300 (e.g., within memory 330) to perform any of a wide variety of tasks/operations associated with device 300, luminaire 100, and/or optional image capture device 400. A given GUI control feature can be used, in accordance with some embodiments, to provide a control signal to device 300, luminaire 100, and/or optional image capture device 400 and can be programmed or otherwise configured to that end using any suitable custom, proprietary, known, and/or after-developed techniques, as desired for a given target application or end-use. In some embodiments in which display 340 is touch-sensitive, GUI 370 correspondingly may be provided as a touchscreen interface with touch-sensitive virtual control features.

Figure 3A:
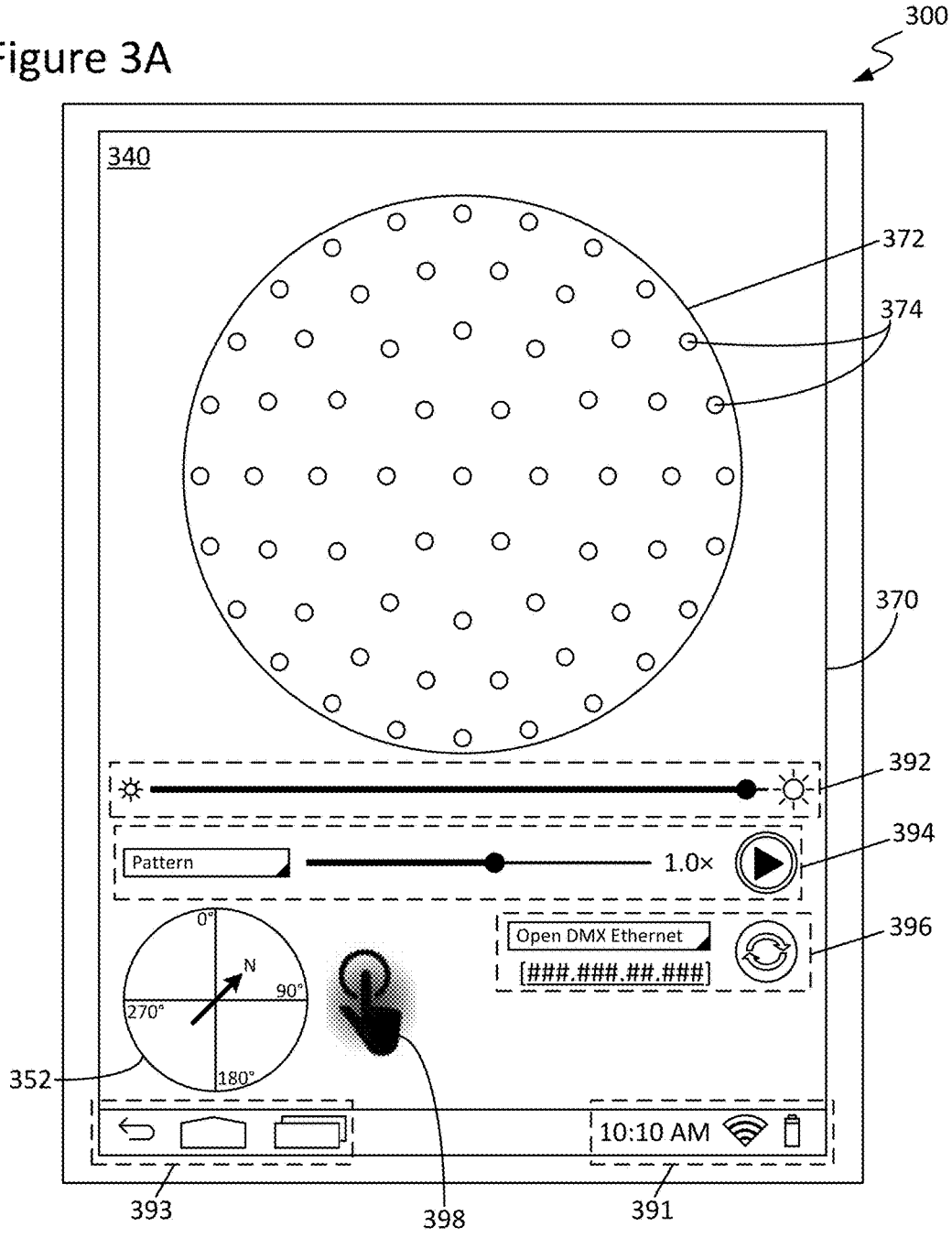
FIG. 3A illustrates an example screenshot of a computing device on which a graphical user interface (GUI) is displayed, in accordance with an embodiment of the present disclosure.

As can be seen, for example, from FIG. 3A, GUI 370 may be configured to provide a graphical canvas 372, in some instances. In accordance with some embodiments, graphical canvas 372 may include within its bounds one or more selectable nodes 374 which may correspond, for example, with the one or more lamps 130 of luminaire 100. In a more general sense, graphical canvas 372 may include a field of selectable GUI control features, elements, icons, and/or other graphical objects that can be used as a selectable node 374, in accordance with some embodiments. Selection of a given node 374 may be made with the user's finger, a stylus, or other suitable implement. As discussed herein, upon selection of a given node 374, the one or more solid-state lamps 130 of luminaire 100 corresponding with such selected node 374 may be turned ON/OFF, in accordance with some embodiments. In some instances, the dimensions and geometry of graphical canvas 372 may be configured to correspond with the maximum light distribution boundary (or some lesser light distribution boundary, if desired) of luminaire 100 with respect to a given space or other surface of incidence (e.g., floor, wall, ceiling, etc.). In some instances, the quantity of nodes 374 displayed within graphical canvas 372 may correspond directly (e.g., one-to-one) with the quantity of controllable lamps 130 of luminaire 100.

Figure 3B:
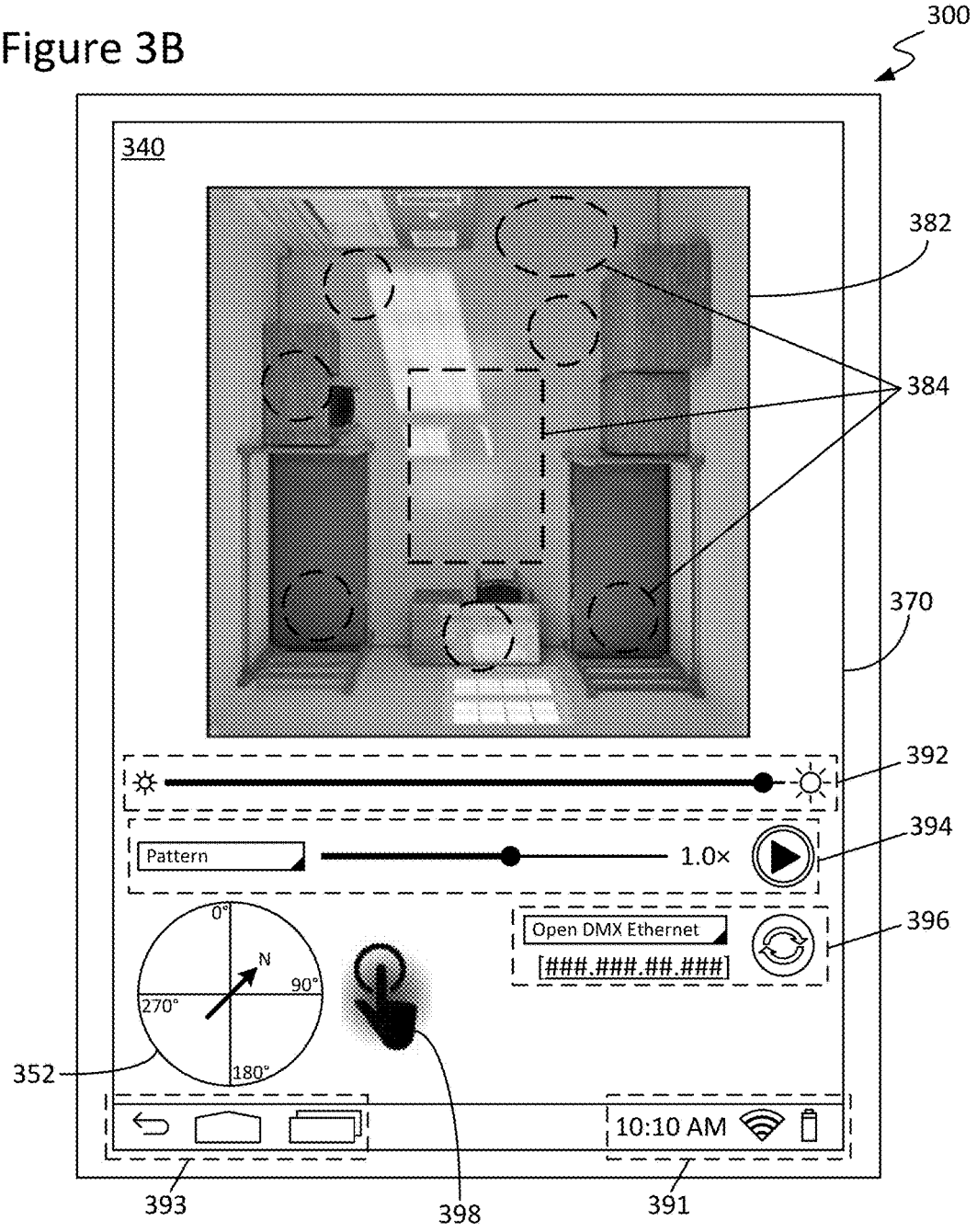
FIG. 3B illustrates an example screenshot of a computing device on which a GUI is displayed, in accordance with another embodiment of the present disclosure.

As can be seen, for example, from FIG. 3B, GUI 370 may be configured to provide a photographical canvas 382, in some instances. In accordance with some embodiments, photographical canvas 382 may comprise, in part or in whole, a photograph or other image captured by image capture device 400 of the target space (e.g., room, surface, etc.) to be lighted by luminaire 100. In some other embodiments, photographical canvas 382 may comprise, in part or in whole, a computer-generated image of the target space as derived from a photograph or other image (e.g., captured by image capture device 400) and/or from scanning the target space (e.g., three-dimensional modeling, machine learning, etc.). In some still other embodiments, photographical canvas 382 may comprise, in part or in whole, a visual rendition (e.g., line drawing, bitmap, grid array, image map, etc.) representative of the space to be lighted by luminaire 100. As will be appreciated in light of this disclosure, and in accordance with some embodiments, a user may alternate between graphical canvas 372 and photographical canvas 382, as desired. In accordance with some embodiments, photographical canvas 382 may provide a view (e.g., a plan view or other desired view from a given vantage point) of a given space or target surface of incidence that is to be lighted by luminaire 100 and may include within its bounds one or more selectable zones 384 corresponding, for example, to areas which may be lighted by luminaire 100. Selection of a given zone 384 within photographical canvas 382 may be made with the user's finger, a stylus, or other suitable implement.

As discussed herein, upon selection of a zone 384, the one or more solid-state lamps 130 of luminaire 100 corresponding with such selected zone 384 may be turned ON/OFF, in accordance with some embodiments. Thus, in a general sense, the photographical canvas 382 provided by GUI 370 may aid a user in making specific lighting distribution selections based on which zone(s) 384 of a given space/surface are to be lighted, and in determining whether a given desired lighting distribution has been achieved. In some cases, photographical canvas 382 may be refreshed or otherwise updated in real time, while in some other cases, refreshing/updating may occur periodically or upon user command using device 300.

As previously noted, GUI 370 may present on display 340 one or more GUI control features designed to aid a user in use, manipulation, and/or operation of device 300, luminaire 100, and/or optional image capture device 400. In particular, upon activation of a given GUI control feature, one or more control signals may be output to alter or otherwise control the performance/behavior of device 300, luminaire 100, and/or optional image capture device 400, in accordance with some embodiments. In some cases in which device 300 includes a touch-sensitive display 340, GUI 370 may include one or more virtual control features (e.g., virtual buttons, switches, knobs, pressure sensors, toggles, sliders) that a user may manually manipulate to aid in providing the desired control/operation of device 300, luminaire 100, and/or optional image capture device 400. However, the present disclosure is not so limited, as in some cases, computing device 300 may include one or more physical control features (e.g., physical buttons, switches, knobs, pressure sensors, toggles, sliders) to any such end. Numerous configurations will be apparent in light of this disclosure.

A given control feature (e.g., virtual and/or physical) may be assigned to or otherwise associated with any of a wide range of functions/operations of device 300, luminaire 100, and/or optional image capture device 400, as desired for a given target application or end-use. For instance, in some cases, a given GUI control feature may be configured to make a selection from one or more options displayed by GUI 370 on display 340. In some instances, a given control feature may be configured to enable/disable computing device 300, image capture device 400 (if optionally included), and/or luminaire 100. In some cases, a given control feature may be configured to perform an image data refresh for optional image capture device 400 to refresh photographical canvas 382. In some instances, GUI 370 may present an intensity adjustment feature 392 configured to adjust the intensity (e.g., brighten and/or dim) the output of the one or more lamps 130 of luminaire 100. In accordance with some embodiments, GUI 370 may be configured to allow control of the intensity, color, and/or color temperature of the light emitted by a given solid-state lamp 130 of a paired luminaire 100.

In some cases, GUI 370 may present one or more network connection management features 396 (e.g., a network selection menu, a network/IP address indicator, a network connection refresh button, etc.). In some such cases, computing device 300 may perform a connection refresh upon user instruction; for example, a user may input a command to computing device 300, which causes it to perform a network connection refresh. However, the present disclosure is not so limited, as in some other cases, computing device 300 may be configured to perform a periodic network connection refresh (e.g., based on a user-defined schedule, a given time interval, etc.) or otherwise as frequently as desired for a given target application or end-use.

In some instances, GUI 370 may present a mode selection feature 398 configured to allow for selection between any of the example lighting distribution modes (e.g., such as beam-adjustable mode, point-to-point mode, auto-sequence mode, distribution-adjustable mode, etc., as discussed below) of which luminaire 100 may be capable. In some cases, GUI 370 may present one or more auto-sequence management features 394 (e.g., a pattern/sequence selection menu, a pattern/sequence start/stop button, a pattern/sequence speed adjuster, etc.) for managing operation of luminaire 100 in an auto-sequence mode. In some instances, GUI 370 may present an orientation indicator feature 352 configured to indicate the directional heading and/or angular orientation of device 300, for example, with respect to a paired luminaire 100, a geomagnetic heading (e.g., geomagnetic north), or other suitable point of reference.

In some cases, GUI 370 may present one or more navigation features 393, such as a Home button, a Back button to allow a user to go back to a previous menu/sub-menu, and/or a Switch Application button to allow a user to switch between currently active applications, among others. In some instances, GUI 370 may present one or more status bars 391 configured to convey information, for example, pertaining to the operation, status, and/or performance of device 300, a paired luminaire 100, and/or an optionally included image capture device 400. Such information may be conveyed by display of one or more icons (e.g., light-based icons) that are indicative of or otherwise associated with any of a wide range of settings/functions of device 300, a paired luminaire 100, and/or a paired image capture device 400. For instance, a given status bar 391 may include a network connection/signal indicator icon that indicates the state of the connection of device 300 with luminaire 100, image capture device 400, and/or network 500 (if present). A given status bar 391 may include a battery life indicator icon that indicates the remaining power available for device 300, luminaire 100, and/or image capture device 400. A given status bar 391 may include a clock icon that indicates the current time.

It should be noted, however, that the present disclosure is not so limited to the example GUI 370 scheme illustrated and discussed in the context of the figures, as any number of GUI schemes and/or hierarchies of GUI control features (e.g., virtual and/or physical) and options may be displayed by display 340 of device 300, in accordance with other embodiments. In a more general sense, a given GUI control feature may be associated with any standard and/or user-defined function, capability, and/or application of device 300, as desired, and may be customized to meet the preferences of a given user.

Optional image capture device 400 can be any device configured to capture digital images, such as a still camera (e.g., a camera configured to capture still photographs) or a video camera (e.g., a camera configured to capture moving images comprising a plurality of frames). Image capture device 400 may include components such as, for example, an optics assembly, an image sensor, and an image/video encoder. These components (and others, if any) of image capture device 400 may be implemented in any combination of hardware, software, and/or firmware, as desired for a given target application or end-use. Also, image capture device 400 can be configured to operate using light, for example, in the visible spectrum and/or other portions of the electromagnetic spectrum, including the infrared (IR) spectrum, ultraviolet (UV) spectrum, etc.

In accordance with some embodiments, image capture device 400 may be aimed (e.g., oriented, focused) such that it captures an image inclusive of a given space, surface of incidence, or other target region to be lighted using luminaire 100. Thus, by virtue of this configuration, image capture device 400 may capture an image of the lighted area and convey that information, for example, to computing device 300 (e.g., where it may be considered by a user to make a determination as to whether a desired lighting distribution has been achieved). As such, it may be desirable, in some instances, to ensure that image capture device 400 is configured to capture images which are of sufficient resolution (e.g., for observation and consideration by a user) to that end. In an example case in which image capture device 400 is mounted on a ceiling or other overhead surface, an image providing an overhead view (e.g., a bird's-eye view) of the lighted space may be conveyed by image capture device 400 to computing device 300. This visual image may be provided to computing device 300, for example, to serve as a photographical canvas 382 for GUI 370, and in some instances may provide the user with improved control over light distribution without having to observe the actual physical space to distribute light in an intended manner.

In some cases, image capture device 400 may be a separate (e.g., stand-alone) device that is configured to communicate with computing device 300 and/or luminaire 100 via wired (e.g., Universal Serial Bus or USB, Ethernet, FireWire, etc.) and/or wireless (e.g., Wi-Fi®, Bluetooth®, etc.) communication. In some other cases, image capture device 400 may be incorporated within computing device 300 (e.g., as a built-in or otherwise on-board image capture device). Some example cases may include: web cameras as may be associated with computers, video monitors, etc.; mobile device cameras (e.g., cell phone or smartphone cameras integrated in, for example, the previously discussed example device); integrated laptop computer cameras; and integrated tablet computer cameras (e.g., iPad®, Galaxy Tab®, and the like). In some still other cases, image capture device 400 may be incorporated within luminaire 100. Other suitable placements and configurations for image capture device 400 will depend on a given application and will be apparent in light of this disclosure.

As previously noted, luminaire 100 may be configured to be capable of outputting light in any of a wide range of light distribution modes, and device 300 with its GUI 370 may be utilized to control such modes, in accordance with some embodiments. For example, consider FIG. 4A, which illustrates an example screenshot of GUI 370 in beam-adjustable mode, in accordance with an embodiment of the present disclosure. As can be seen, in beam-adjustable mode, a cursor 376 may be displayed over graphical canvas 372. The cursor 376 may be made to encompass one or more nodes 374 (or no nodes 374 at all, if desired). To that end, the geometry (e.g., circular, elliptical, square, rectangular, etc.) and/or size of cursor 376 can be customized by a user. In accordance with some embodiments, each node 374 that is enclosed by cursor 376 may be toggled into an ON state, which, in turn, may be interpreted by a given controller 200 of luminaire 100 to toggle a lamp 130 corresponding to that node 374 into an ON state. Any node 374 that is not enclosed by cursor 376 may remain in an OFF state; accordingly, a given controller 200 of luminaire 100 may retain any lamps 130 corresponding with those nodes 374 in an OFF state, in accordance with some embodiments. Thus, and in accordance with some embodiments, the light distribution of the lamps 130 of luminaire 100 may be controlled using the GUI 370 of device 300, for example, by changing the size (e.g., expanding; shrinking), geometry (e.g., curved; polygonal), and/or position of cursor 376 on graphical canvas 372 to encompass greater, lesser, or otherwise different quantities of nodes 374.

In cases in which a touch-sensitive GUI 370 is provided, adjustment and/or movement of cursor 376 may be made using the user's finger, a stylus, or other suitable touchscreen implement. In an example case, a user may utilize an inward and/or outward pinch gesture to enlarge and/or diminish the size of cursor 376. In another example case, a user may drag his finger or a stylus about graphical canvas 372 to reposition cursor 376 thereon.

Figure 4A:
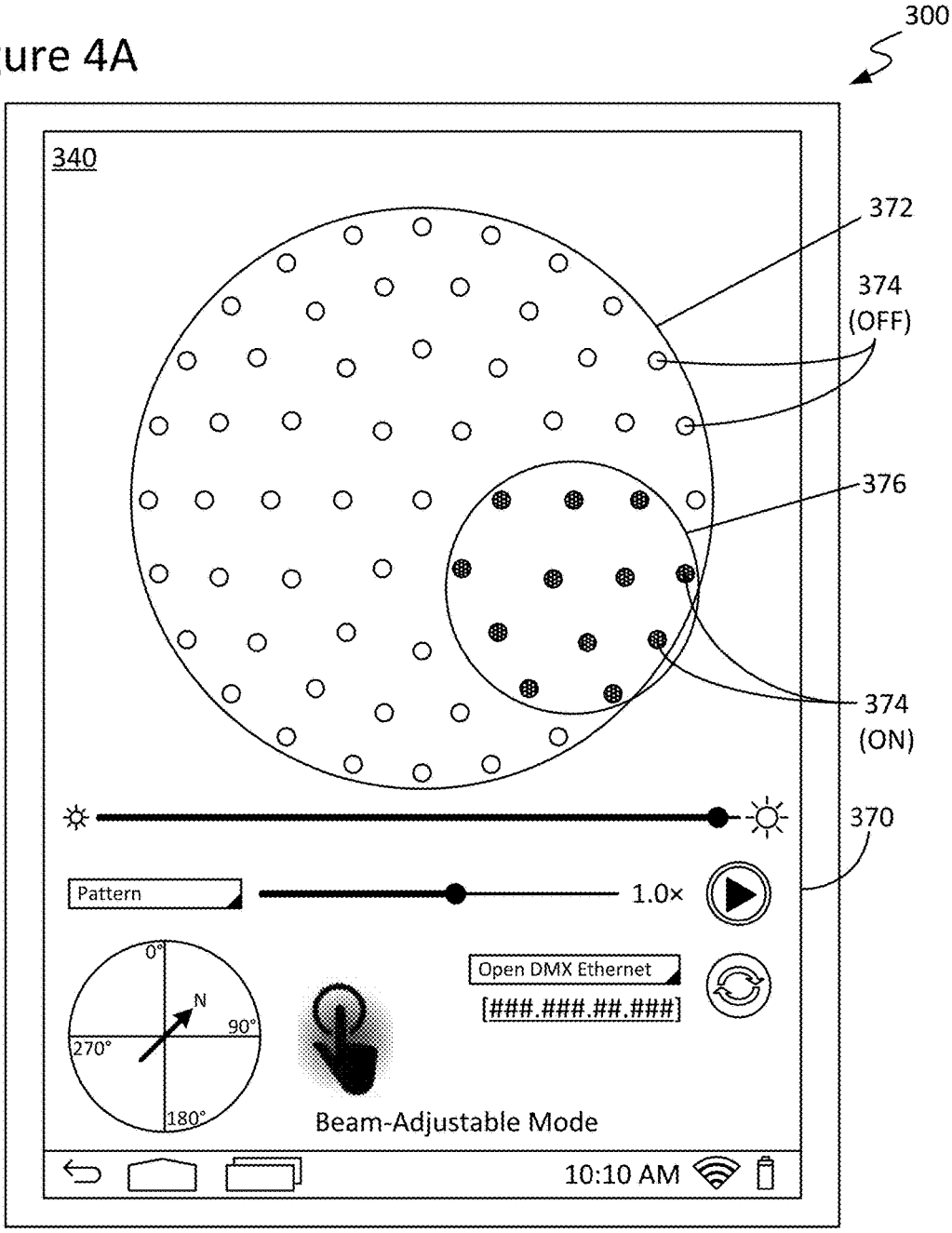
FIG. 4A illustrates an example screenshot of a GUI in beam-adjustable mode, in accordance with an embodiment of the present disclosure.
Figure 4B:
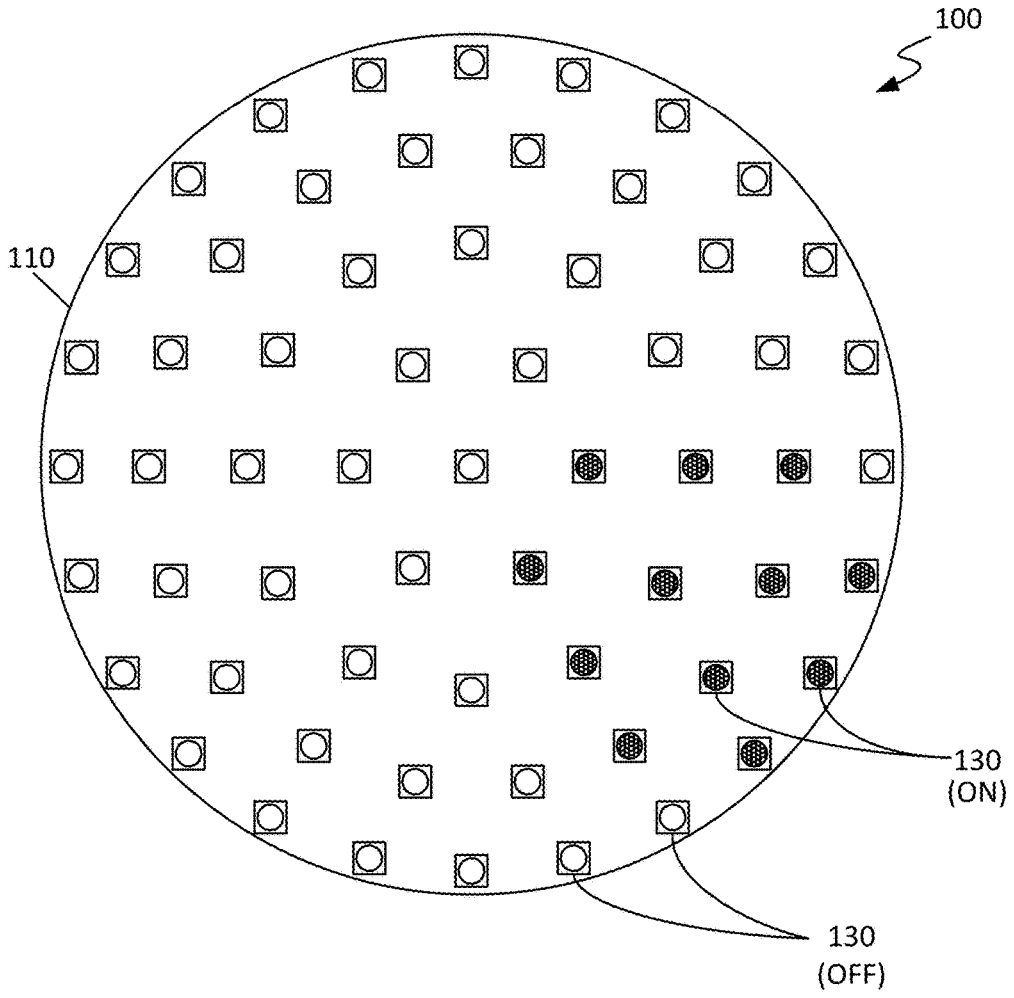
FIG. 4B is a plan view of a luminaire in beam-adjustable mode corresponding with the example node selections depicted in the GUI screenshot of FIG. 4A.

As cursor 376 is adjusted on graphical canvas 372, the light distribution of luminaire 100 may change accordingly. For example, consider FIG. 4B, which is a plan view of a luminaire 100 in beam-adjustable mode corresponding with the example node 374 selections depicted in the GUI 370 screenshot of FIG. 4A. As can be seen, the lamps 130 corresponding with the selected nodes 374 encompassed by cursor 376 in FIG. 4A are in an ON state, whereas those lamps 130 corresponding with nodes 374 not encompassed by cursor 376 in FIG. 4A are in an OFF state. As will be appreciated in light of this disclosure, and in accordance with some embodiments, adjustment and/or repositioning of cursor 376 may produce a corresponding change in which lamp(s) 130 of luminaire 100 are in an ON state at any given moment.

A user can utilize GUI 370 to enter various commands into device 300 to control the size and/or the direction of the light beam output by luminaire 100, thus permitting the user to distribute light in a given space or on a given surface of incidence, as desired. For example, in some cases in which device 300 includes a touch-sensitive display 340, a user can perform a touch-based inward and/or outward pinch gesture to vary the size (e.g., diameter/width) of the light beam output by luminaire 100. Also, the user can drag cursor 376 around within graphical canvas 372 to change the direction of the light beam output by luminaire 100. In some cases, GUI 370 can be utilized to select a group of nodes 374, and thus a group of lamps 130 (e.g., a sub-set or all available lamps 130 of luminaire 100), to be turned ON, for example, to provide a given lighting distribution in a given region of the target space or surface of incidence. GUI 370 may include an option, for example, to allow a user to operatively group/ungroup nodes 374 (and thus lamps 130) as desired.

Figure 4C:
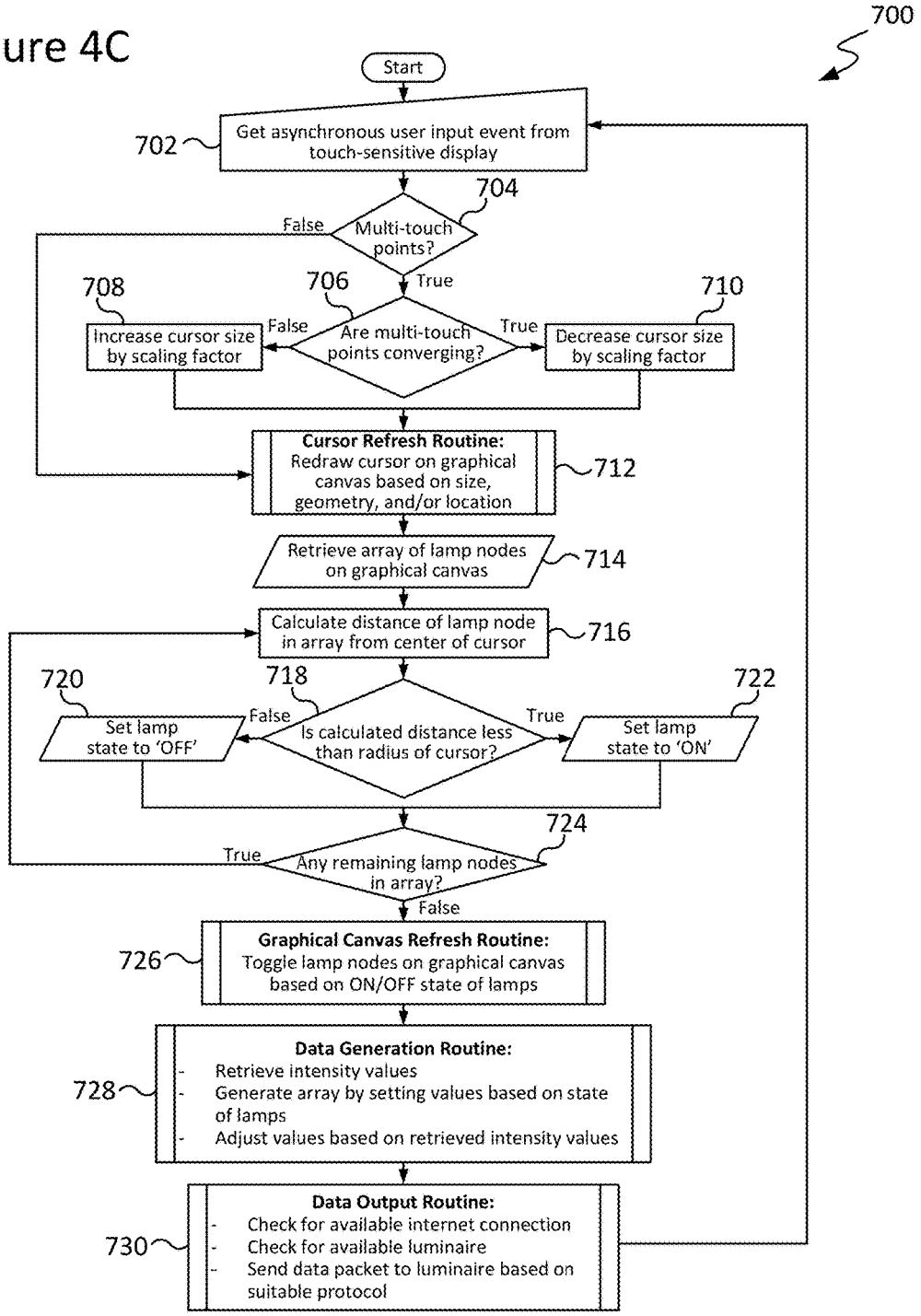
FIG. 4C is a process flow illustrating an algorithm for controlling a luminaire in a beam-adjustable mode using a touch-sensitive GUI, in accordance with an embodiment of the present disclosure.

FIG. 4C is a process flow illustrating an algorithm 700 for controlling a luminaire 100 in a beam-adjustable mode using a touch-sensitive GUI 370, in accordance with an embodiment of the present disclosure. The algorithm 700 of FIG. 4C can be implemented, for example, using a computing device 300 (discussed herein), in accordance with some embodiments. As can be seen, algorithm 700 may begin as in block 702 with obtaining from a touch-sensitive display 340 (or other touch-sensitive surface of device 300) an asynchronous user input event (e.g., touching of display 340 with a finger, stylus, etc.). Algorithm 700 may continue as in block 704 with determining whether there are any multi-touch points detected (e.g., detecting whether a user has placed two or more fingers, styluses, etc., on display 340). If no multi-touch points are detected, then algorithm 700 may continue as in block 712 (discussed below) with performing a refresh cursor routine. Otherwise, if multi-touch points are detected, then algorithm 700 may continue as in block 706 with determining whether the multi-touch points are converging. If the multi-touch points are not converging (e.g., are diverging), then algorithm 700 may continue as in block 708 with increasing the size of cursor 376 by a given scaling factor. If instead the multi-touch points are converging, then algorithm 700 may continue as in block 710 with decreasing the size of cursor 376 by a given scaling factor.

Thereafter, algorithm 700 may continue as in block 712 with performing a cursor refresh routine. In this routine, cursor 376 may be redrawn on graphical canvas 372 based on its size, geometry, and/or location. Algorithm 700 then may continue as in block 714 with retrieving the array of nodes 374 (e.g., LED points) on graphical canvas 372 and, as in block 716, calculating the distance of each lamp node 374 in the array from the center of cursor 376. Then, algorithm 700 may continue as in block 718 with determining whether the calculated distance is less than the radius of cursor 376. If the calculated distance is not less than the radius of cursor 376 (e.g., the node 374 is outside of the bounds of cursor 376), then algorithm 700 may continue as in block 720 with setting a corresponding lamp 130 of luminaire 100 to an OFF state. If instead the calculated distance is less than the radius of cursor 376 (e.g., the node 374 is enclosed by the bounds of cursor 376), then algorithm 700 may continue as in block 722 with setting a corresponding lamp 130 of luminaire 100 to an ON state.

Thereafter, algorithm 700 may continue as in block 724 with determining whether there are any remaining lamp nodes 374 in the retrieved array. If there is at least one remaining lamp node 374 in the retrieved array, then algorithm 700 may return to block 716, discussed above. If instead there are no remaining lamp nodes 374 in the retrieved array, then algorithm 700 may proceed as in block 726 with performing a graphical canvas refresh routine. In this routine, graphical canvas 372 may be updated by toggling (e.g., re-coloring, re-shading, etc.) the lamp nodes 374 on graphical canvas 372 based on the ON/OFF states of the lamps 130 of luminaire 100.

Algorithm 700 may continue as in block 728 with performing a data generation routine. In this routine, the intensity values (e.g., which may be set by a user, for instance, using an intensity adjustment feature 392 configured to brighten and/or dim the output of the lamps 130 of luminaire 100, as discussed above) may be retrieved. Next, an array may be generated by setting its values based on the ON/OFF states of the lamps 130 of luminaire 100. Then, the values of the array may be adjusted based on the retrieved intensity values. In some instances, the generated data may be compiled or otherwise provided, for example, as an ArtNET DMX data packet. Other suitable packet types will depend on a given application and will be apparent in light of this disclosure.

Thereafter, algorithm 700 may continue as in block 730 with performing a data output routine. This routine may include determining whether an internet connection (e.g., wired, wireless, or other suitable network connection type) is available for transmission of the data packet. The routine also may include determining whether a luminaire 100 is available for transmission of the data packet (e.g., determining whether a given luminaire 100 is configured as an ArtNET adapter node or other suitable recipient). Furthermore, the routine may include sending the data packet over the connection to a given luminaire 100 using a given suitable protocol (e.g., ArtNET protocol or any other suitable protocol). Subsequently, algorithm 700 may return to obtaining an asynchronous user input event using touchscreen display 340, as in block 702.

Figure 5A:
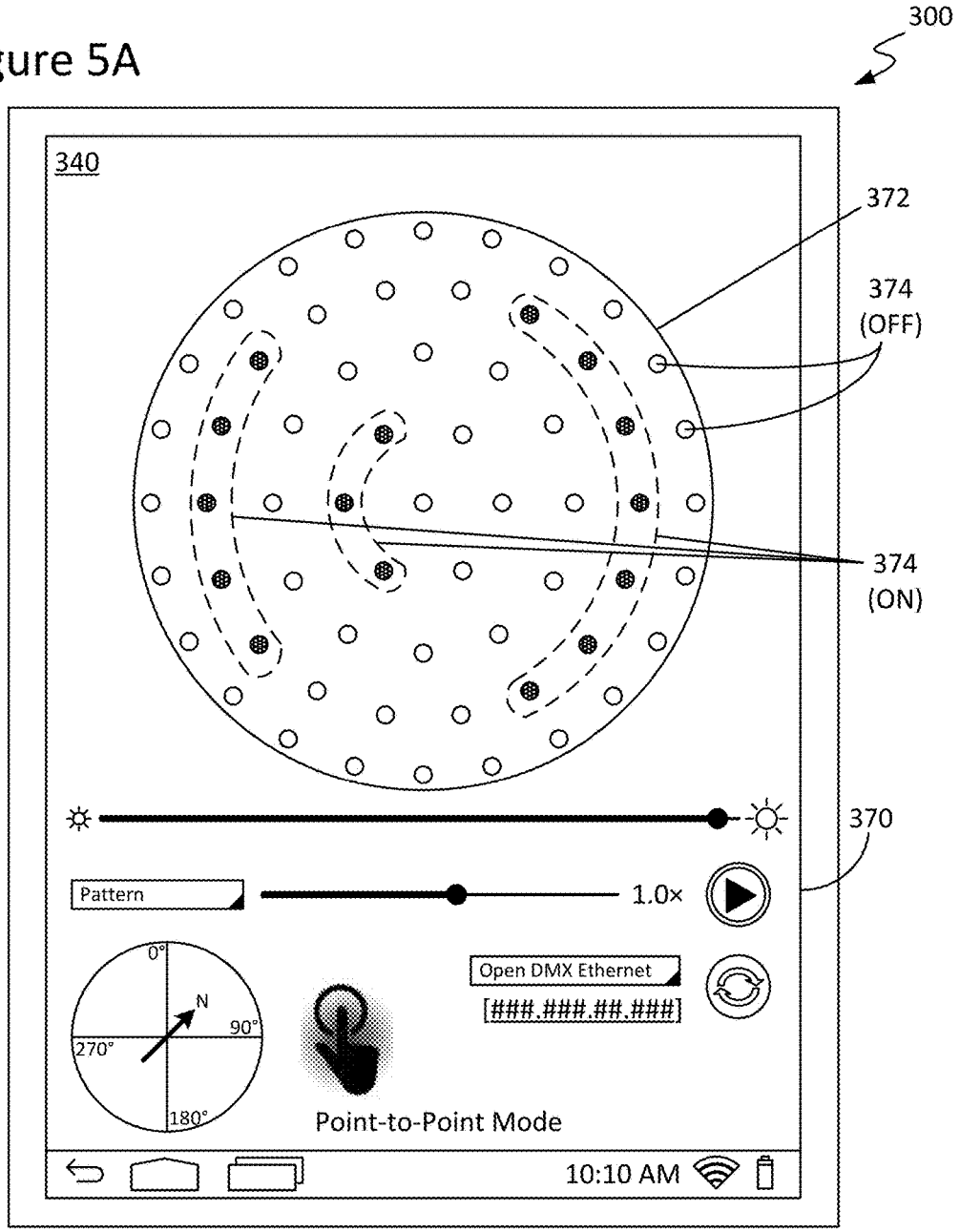
FIG. 5A illustrates an example screenshot of a GUI in point-to-point mode, in accordance with an embodiment of the present disclosure.

FIG. 5A illustrates an example screenshot of GUI 370 in point-to-point mode, in accordance with an embodiment of the present disclosure. As can be seen, in point-to-point mode, a given node 374 of interest on graphical canvas 372 may be toggled to change the state of a corresponding lamp 130 of a paired luminaire 100. In accordance with some embodiments, each node 374 that is toggled into an ON state may be interpreted by a given controller 200 of luminaire 100 to toggle a lamp 130 corresponding to that node 374 into an ON state. Any node 374 that is not toggled may remain in an OFF state; accordingly, a given controller 200 of luminaire 100 may retain any lamps 130 corresponding with those nodes 374 in an OFF state, in accordance with some embodiments. Thus, and in accordance with some embodiments, each lamp 130 can be turned ON/OFF individually, allowing for discrete control over the light distribution of luminaire 100 using the GUI 370 of device 300, for example, to illuminate any desired region of a given space or surface of incidence. In cases in which a touch-sensitive GUI 370 is provided, toggling of a given node 374 may be made using the user's finger, a stylus, or other suitable touchscreen implement.

Figure 5B:
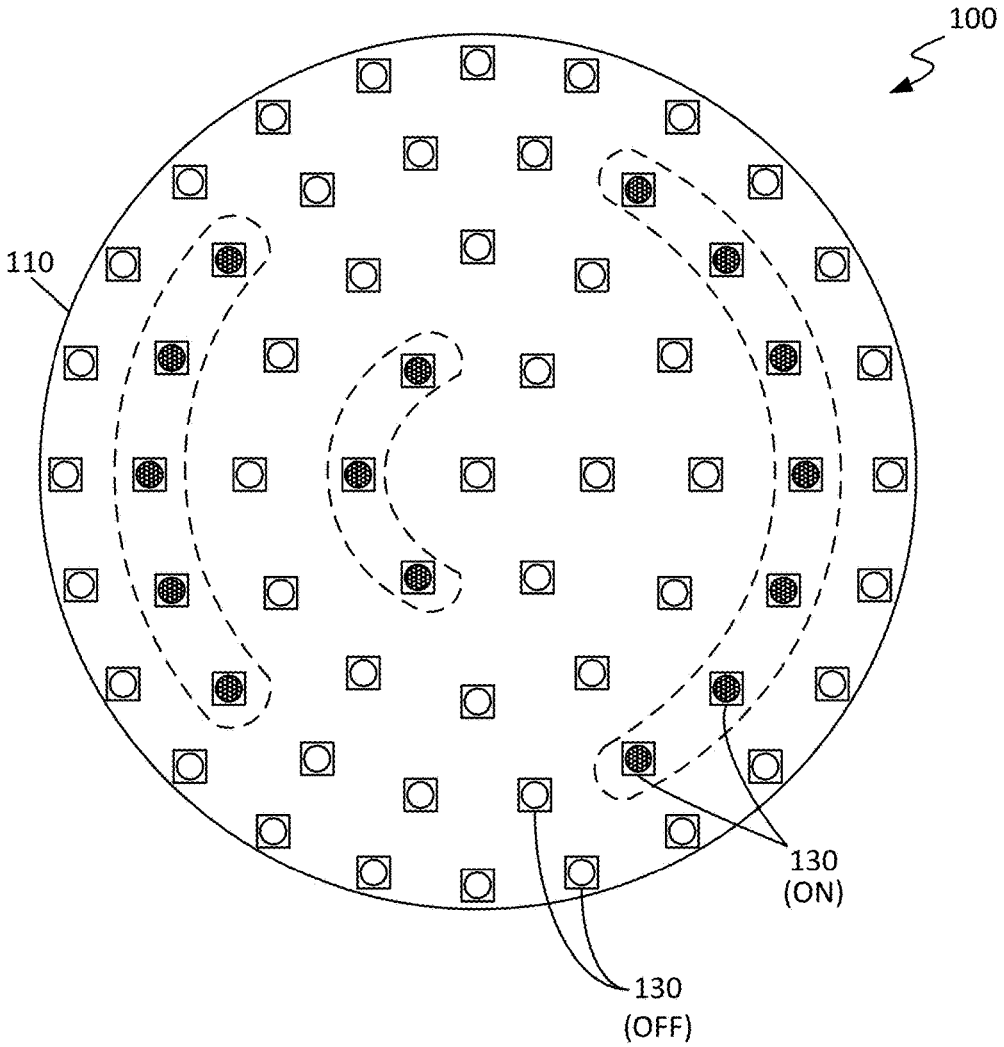
FIG. 5B is a plan view of a luminaire in point-to-point mode corresponding with the example node selections depicted in the GUI screenshot of FIG. 5A.

As a given node 374 is toggled on graphical canvas 372, the light distribution of luminaire 100 may change accordingly. For example, consider FIG. 5B, which is a plan view of a luminaire 100 in point-to-point mode corresponding with the example node 374 selections depicted in the GUI 370 screenshot of FIG. 5A. As can be seen, the lamps 130 corresponding with the toggled nodes 374 in FIG. 5A are in an ON state, whereas those lamps 130 corresponding with nodes 374 not toggled in FIG. 5A are in an OFF state. A user can utilize GUI 370 to enter various commands into device 300 to control the size and/or the direction of the light beam output by luminaire 100, thus permitting the user to distribute light in a given space or on a given surface of incidence, as desired. For example, in some cases in which device 300 includes a touch-sensitive display 340, a user can touch a greater or lesser quantity of nodes 374 to vary the size (e.g., diameter/width) and/or direction of the light beam output by luminaire 100.

Figure 5C:
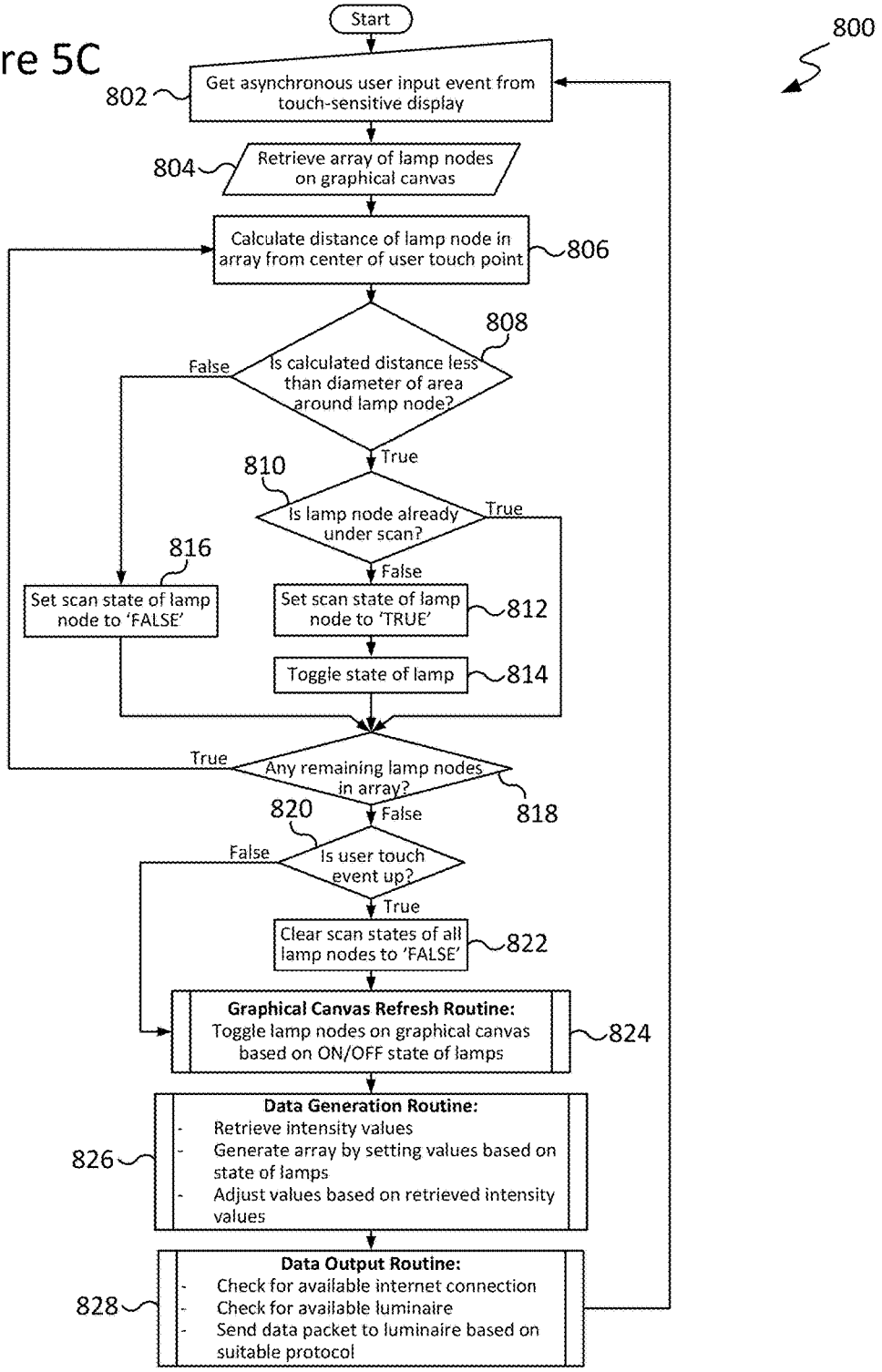
FIG. 5C is a process flow illustrating an algorithm for controlling a luminaire in a point-to-point mode using a touch-sensitive GUI, in accordance with an embodiment of the present disclosure.

FIG. 5C is a process flow illustrating an algorithm 800 for controlling a luminaire 100 in a point-to-point mode using a touch-sensitive GUI 370, in accordance with an embodiment of the present disclosure. The algorithm 800 of FIG. 5C can be implemented, for example, using a computing device 300 (discussed herein), in accordance with some embodiments. As can be seen, algorithm 800 may begin as in block 802 with obtaining from a touch-sensitive display 340 (or other touch-sensitive surface of device 300) an asynchronous user input event (e.g., touching of display 340 with a finger, stylus, etc.). Algorithm 800 may continue as in block 804 with retrieving the array of nodes 374 (e.g., LED points) on graphical canvas 372 and, as in block 806, calculating the distance of each lamp node 374 in the array from the center of the user touch point. Then, algorithm 800 may continue as in block 808 with determining whether the calculated distance is less than the diameter of a given area around the lamp node 374. If the calculated distance is not less than the diameter, then algorithm 800 may continue as in block 816 with setting the scan state of the lamp node 374 to 'FALSE.' If instead the calculated distance is less than the diameter, then algorithm 800 may continue as in block 810 with determining whether the lamp node 374 is already under scan. If the lamp node 374 is already under scan, then algorithm 800 may proceed as in block 818, discussed below. If instead the lamp node 374 is not already under scan, then algorithm 800 may proceed as in block 812 with setting the scan state of the lamp node 374 to 'TRUE' and toggling the state of the lamp 130, as in block 814.

Thereafter, algorithm 800 may continue as in block 818 with determining whether there are any remaining lamp nodes 374 in the array. If there is at least one remaining lamp node 374 in the retrieved array, then algorithm 800 may proceed as in block 806, as discussed above. If instead there are no remaining lamp nodes 374 in the retrieved array, then algorithm 800 may proceed as in block 820 with determining whether a user touch event is up. If a user touch event is not up, then algorithm 800 may proceed as in block 824 with performing a graphical canvas refresh routine, as discussed below. If instead a user touch event is up, then algorithm 800 may proceed as in block 822 with clearing the scan states of all lamp nodes 374 to 'FALSE.'

Algorithm 800 may proceed as in block 824 with performing a graphical canvas refresh routine. In this routine, graphical canvas 372 may be updated by toggling (e.g., re-coloring, re-shading, etc.) the lamp nodes 374 on graphical canvas 372 based on the ON/OFF states of the lamps 130 of luminaire 100. Algorithm 800 may continue as in block 826 with performing a data generation routine. This routine may be performed, in some cases, in substantially the same manner as the data generation routine discussed above with respect to block 728 of FIG. 4C. Thereafter, algorithm 800 may continue as in block 828 with performing a data output routine. This routine may be performed, in some cases, in substantially the same manner as the data output routine discussed above with respect to block 730 of FIG. 4C. Subsequently, algorithm 800 may return to obtaining an asynchronous user input event using touchscreen display 340, as in block 802.

Figure 6A:
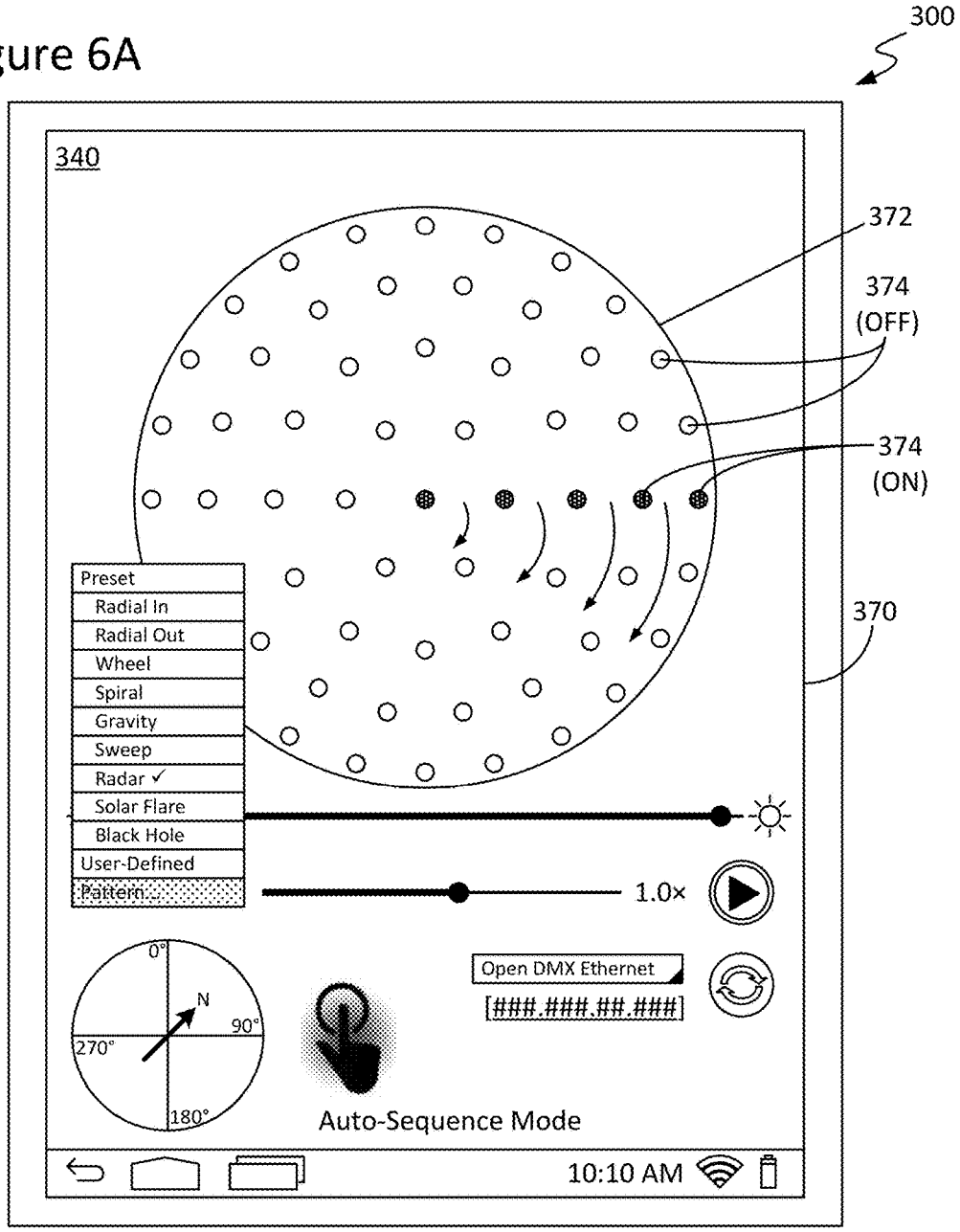
FIG. 6A illustrates an example screenshot of a GUI in auto-sequence mode, in accordance with an embodiment of the present disclosure.

FIG. 6A illustrates an example screenshot of GUI 370 in auto-sequence mode, in accordance with an embodiment of the present disclosure. As can be seen, in auto-sequence mode, the regular or otherwise well-defined arrangement of lamps 130 of luminaire 100 may be exploited, for example, to generate a given desired lighting pattern/sequence with luminaire 100. That is, in accordance with some embodiments, automated lighting patterns may be generated in a given space or on a given surface of incidence by turning appropriate lamps 130 ON/OFF in a given desired pattern and/or sequence. In accordance with some embodiments, each node 374 that is toggled into an ON state may be interpreted by a given controller 200 of luminaire 100 to toggle a lamp 130 corresponding to that node 374 into an ON state. Any node 374 that is not toggled may remain in an OFF state; accordingly, a given controller 200 of luminaire 100 may retain any lamps 130 corresponding with those nodes 374 in an OFF state, in accordance with some embodiments.

In some instances, toggling of the states of lamps 130 may be made to form a pattern/sequence. In some such instances, the pattern/sequence may be preset or otherwise predetermined and available for selection. In some other such instances, a user may provide input through GUI 370 using graphical canvas 372 to generate a user-defined pattern/sequence. Selection of a given auto-sequence mode may be made, for example, from a pattern/sequence selection menu or other auto-sequence management feature 394, as discussed above. Upon selection or generation of a given pattern/sequence via GUI 370, one or more of the lamps 130 of luminaire 100 can be turned ON/OFF sequentially and/or simultaneously to form the pattern/sequence. In addition, changes to intensity (e.g., using an intensity adjustment feature 392 configured to brighten and/or dim the output of the lamps 130 of luminaire 100, as discussed above) and/or pattern/sequence speed (e.g., using a pattern sequence speed adjuster or other auto-sequence management feature 394, as discussed above) may be made, as desired. Thus, and in accordance with some embodiments, the light distribution of the lamps 130 of luminaire 100 may be controlled using the GUI 370 of device 300, for example, to provide any of a wide range of patterns/sequences of illumination in a given space or on a given surface of incidence.

In cases in which a touch-sensitive GUI 370 is provided, selection and/or generation of a given pattern/sequence may be made using the user's finger, a stylus, or other suitable touchscreen implement. It should be noted, however, that the present disclosure is not so limited only to dynamic (e.g., changing; evolving; animated) patterns/sequences, as in some other embodiments, a static pattern (e.g., a star shape, a ring shape, an arrow shape, an alphanumeric character, etc.) may be provided.

Figure 6B:
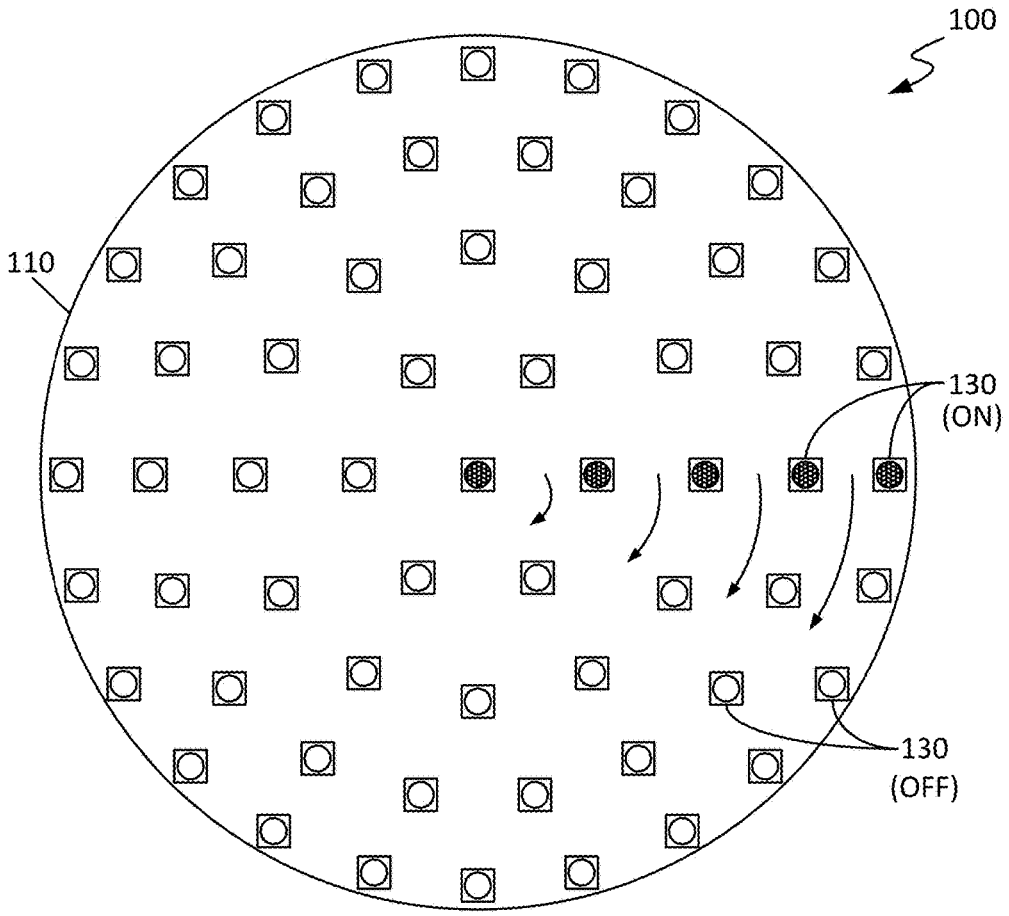
FIG. 6B is a plan view of a luminaire in auto-sequence mode corresponding with the example pattern/sequence selection depicted in the GUI screenshot of FIG. 6A.

As a given pattern/sequence progresses on graphical canvas 372, the light distribution of luminaire 100 may change accordingly. For example, consider FIG. 6B, which is a plan view of a luminaire 100 in auto-sequence mode corresponding with the example pattern/sequence selection depicted in the GUI 370 screenshot of FIG. 6A. As can be seen, the lamps 130 corresponding with the selected nodes 374 utilized by the example pattern/sequence selected in FIG. 6A are in an ON state, whereas those lamps 130 corresponding with nodes 374 not (yet, if at all) utilized in the example pattern/sequence selected in FIG. 6A are in an OFF state. As will be appreciated in light of this disclosure, and in accordance with some embodiments, selection and/or generation of a different pattern/sequence may produce a corresponding change in which lamp(s) 130 of luminaire 100 are in an ON state at any given moment. A user can utilize GUI 370 to enter various commands into device 300 to control the type, speed, and/or intensity of the patterned/sequenced light beam output by luminaire 100, thus permitting the user to distribute light in a given space or on a given surface of incidence, as desired.

Figure 6C:
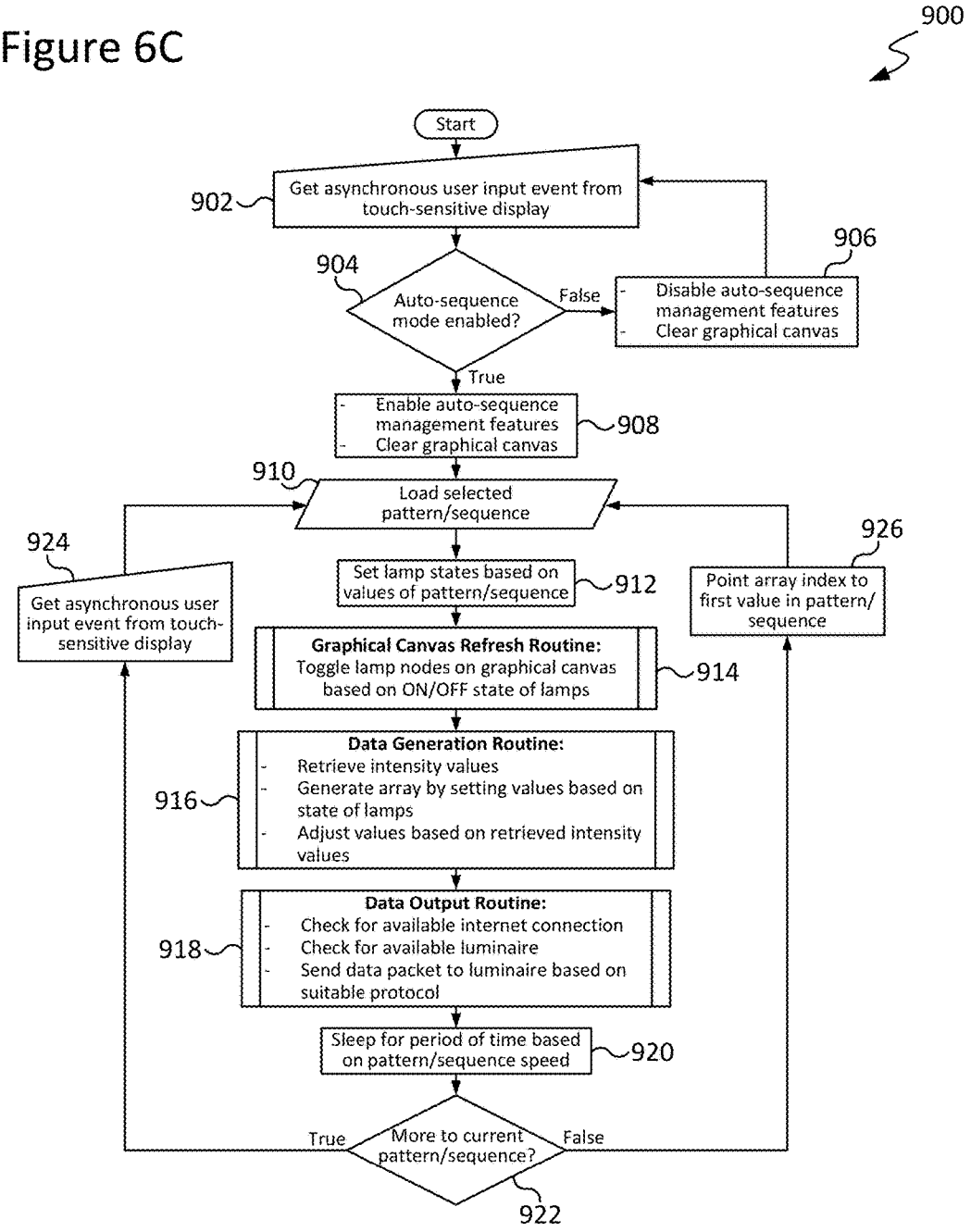
FIG. 6C is a process flow illustrating an algorithm for controlling a luminaire in an auto-sequence mode, in accordance with an embodiment of the present disclosure.

FIG. 6C is a process flow illustrating an algorithm 900 for controlling a luminaire 100 in an auto-sequence mode, in accordance with an embodiment of the present disclosure. The algorithm 900 of FIG. 6C can be implemented, for example, using a computing device 300 (discussed herein), in accordance with some embodiments. As can be seen, algorithm 900 may begin as in block 902 with obtaining from a touch-sensitive display 340 (or other touch-sensitive surface of device 300) an asynchronous user input event (e.g., touching of display 340 with a finger, stylus, etc.). Algorithm 900 may continue as in block 904 with determining whether auto-sequence mode has been enabled. If auto-sequence mode has not been enabled, then algorithm 900 may continue as in block 906 with disabling the associated one or more auto-sequence management features 394 (e.g., a pattern/sequence selection menu, a pattern/sequence start/stop button, a pattern/sequence speed adjuster, etc.) and clearing graphical canvas 372. If instead auto-sequence mode has been enabled, then algorithm 900 may continue as in block 908 with enabling one or more associated auto-sequence management features 394 and clearing graphical canvas 372.

Algorithm 900 may continue as in block 910 with loading a currently selected pattern/sequence. In some cases in which the selected pattern/sequence is dynamic (e.g., moving, animated, or otherwise evolving), it may be desirable to load the pattern/sequence, for example, into a buffer. Thereafter, algorithm 900 may proceed as in block 912 with setting the lamp 130 states based on the values of the selected pattern/sequence.

Next, algorithm 900 may continue as in block 914 with performing a graphical canvas refresh routine. In this routine, graphical canvas 372 may be updated by toggling (e.g., re-coloring, re-shading, etc.) the lamp nodes 374 on graphical canvas 372 based on the ON/OFF states of the lamps 130 of luminaire 100 during the pattern/sequence progression. Algorithm 900 may continue as in block 916 with performing a data generation routine. This routine may be performed, in some cases, in substantially the same manner as the data generation routine discussed above with respect to block 728 of FIG. 4C. Thereafter, algorithm 900 may continue as in block 918 with performing a data output routine. This routine may be performed, in some cases, in substantially the same manner as the data output routine discussed above with respect to block 730 of FIG. 4C.

Next, algorithm 900 may proceed as in block 920 with sleeping or otherwise temporarily halting processing for a given period of time based, at least in part, on the current pattern/sequence speed. In some example cases, this sleep period may be in the range of about 0.1-10.0 ms (e.g., about 1.0-2.5 ms, about 2.5-5.0 ms, about 5.0-7.5 ms, about 7.5-10.0 ms, or any other sub-range in the range of about 0.1-10.0 ms). Thereafter, if there are one or more additional frames to the selected pattern/sequence, then algorithm 900 may proceed as in block 924 with obtaining an asynchronous user input event using touchscreen display 340 (e.g., as discussed above with reference to block 902) and returning to loading the selected pattern/sequence, as in block 910. If instead there are no additional frames remaining to the selected pattern/sequence, then algorithm 900 may proceed as in block 926 with pointing the array index to the first value in the selected pattern/sequence and retuning to loading the selected pattern/sequence, as in block 910.

Numerous variations on these algorithms (e.g., FIGS. 4C, 5C, and 6C) will be apparent in light of this disclosure. As will be appreciated, and in accordance with an embodiment, each of the functional boxes and decision points shown in FIGS. 4C, 5C, and 6C can be implemented, for example, as a module or sub-module that, when executed by one or more processors or otherwise operated, causes the associated functionality as described herein to be carried out. The modules/sub-modules may be implemented, for instance, in software (e.g., executable instructions stored on one or more computer-readable media), firmware (e.g., embedded routines of a microcontroller or other device which may have I/O capacity for soliciting input from a user and providing responses to user requests), and/or hardware (e.g., gate level logic, field programmable gate array, purpose-built silicon, etc.).

As previously noted, luminaire 100 may be configured to be capable of outputting light in any of a wide range of light distribution modes, and device 300 with its GUI 370 may be utilized to control such modes, in accordance with some embodiments. It should be further noted, however, that the present disclosure is not so limited to the example beam-adjustable, point-to-point, and auto-sequence modes discussed herein.

For instance, in accordance with some embodiments, luminaire 100 may be configured for a distribution-adjustable mode. That is, in accordance with some embodiments, luminaire 100 can be used to provide accent lighting or area lighting of any of a wide variety of distributions (e.g., narrow, wide, asymmetric/tilted, Gaussian, batwing, or other specifically shaped beam distribution). By turning ON/OFF and/or dimming/brightening the intensity of various combinations of solid-state emitter devices of luminaire 100, the light beam output may be adjusted, for instance, to produce uniform illumination on a given surface, to fill a given space with light, or to generate any desired area lighting distributions.

Also, in some instances, luminaire 100 can be used to generate any of a wide range of spot shapes, such as, for example, a circle or ellipse, a square or rectangle (e.g., which can be used to fill corner areas), a star, an arrow, or other fanciful or customized shape, as desired. In some embodiments, luminaire 100 can be used to generate a user-designated or otherwise custom spot shape (e.g., such as by drawing on a touch-sensitive display 340 of computing device 300).

Figure 7A:
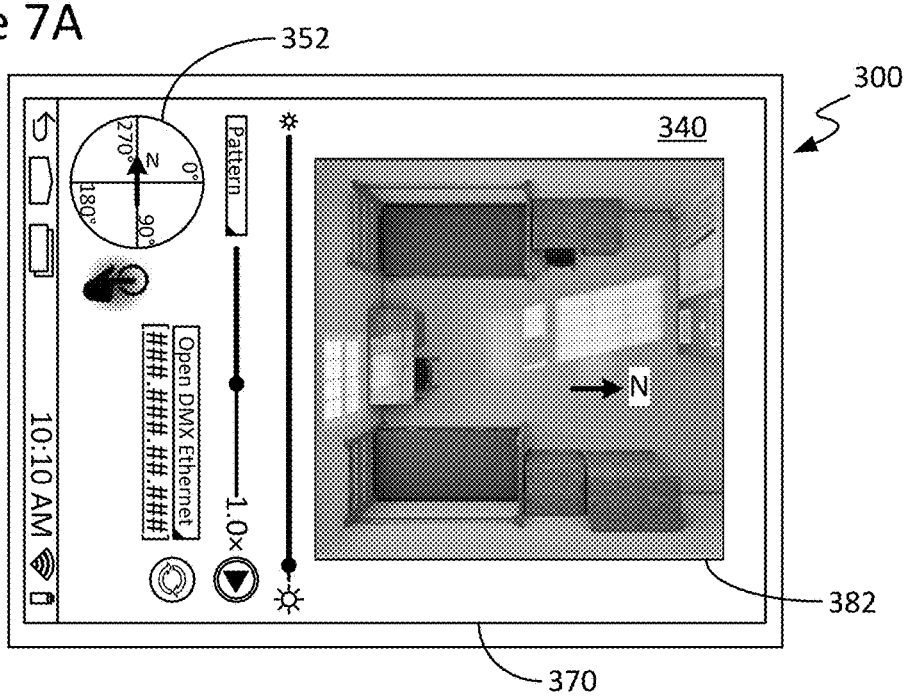
FIG. 7A illustrates an example screenshot of a GUI with auto-orientation mode disabled, in accordance with an embodiment of the present disclosure.
Figure 7B:
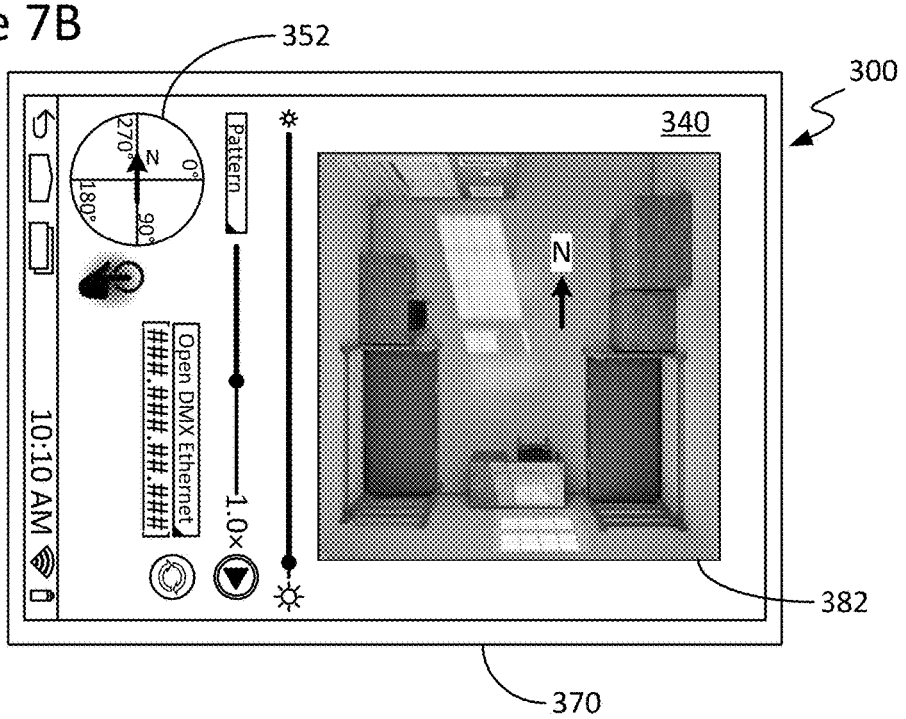
FIG. 7B illustrates an example screenshot of a GUI with auto-orientation mode enabled, in accordance with an embodiment of the present disclosure.

In accordance with some embodiments, device 300 may include an auto-orientation mode for GUI 370. FIG. 7A illustrates an example screenshot of GUI 370 with auto-orientation mode disabled, in accordance with an embodiment of the present disclosure. Conversely, FIG. 7B illustrates an example screenshot of GUI 370 with auto-orientation mode enabled, in accordance with an embodiment of the present disclosure. As can be seen from these figures, when auto-orientation mode is not enabled (e.g., optional position and/or motion sensor 350 is disabled or omitted), rotation of device 300 with respect to luminaire 100 may not produce a corresponding reorientation of photographical canvas 382. In the example of FIG. 7A, device 300 has been rotated through an angle of about 270°, yet north in the photographical canvas 382 does not align with north on the orientation indicator feature 352.

However, when auto-orientation mode is enabled (e.g., optional position and/or motion sensor 350 is enabled), rotation of device 300 with respect to luminaire 100 may produce a corresponding reorientation of photographical canvas 382. That is, when enabled, the position and/or motion sensor 350 of computing device 300 can latch the image of the photographical canvas 382 in the direction of the actual space. Thus, when the orientation of computing device 300 is changed, the image of photographical canvas 382 displayed on display 340 may change accordingly. In the example of FIG. 7B, device 300 has been rotated through an angle of about 270°, and north in the photographical canvas 382 aligns with north on the orientation indicator feature 352. Thus, in the depicted example, photographical canvas 382 has been rotated/reoriented on display 340 of computing device 300 to maintain directional accuracy (e.g., to ensure that north in the image of photographical canvas 382 continues to point towards geomagnetic north).

It should be noted that the present disclosure is not so limited to implementation of auto-orientation mode only with photographical canvas 382, as in some other embodiments, auto-orientation mode may be implemented with graphical canvas 372, discussed above. Also, it should be noted that the present disclosure is not so limited to implementation of auto-orientation mode only through magnetic reference with respect geomagnetic poles, as in some other embodiments, auto-orientation mode may be implemented through visual data (e.g., an image taken from image capture device 400). In any case, auto-orientation mode may permit GUI 370, in part or in whole, to orient itself with respect to the surroundings using information about the space where the light is to be distributed. The acquired orientation information (e.g., geomagnetic data, visual data) can be utilized to orient graphical canvas 372 and/or photographical canvas 382 to the actual orientation of the space itself irrespective of the orientation of computing device 300 (e.g., as held by a user).

Numerous embodiments will be apparent in light of this disclosure. One example embodiment provides a method of electronically controlling a light beam distribution of a solid-state luminaire, the method including: presenting a field of selectable control features on a computing device configured to be communicatively coupled with the solid-state luminaire, wherein at least one of the field of selectable control features is presented as a graphical canvas including one or more selectable nodes corresponding to one or more light sources of the solid-state luminaire; and adjusting the light beam distribution of the solid-state luminaire based on a selection of one of the one or more selectable nodes. In some cases, the computing device includes at least one of a laptop/notebook computer, a tablet computer, a mobile phone, a smartphone, a personal digital assistant (PDA), a portable media player (PMP), a cellular handset, a handheld gaming device, a gaming platform, a desktop computer, and/or a television set. In some instances, the computing device includes a touch-sensitive display on which the field of selectable control features is presented as one or more light-based icons. In some cases, selection of a selectable node of the graphical canvas toggles a corresponding one or more light sources of the solid-state luminaire on/off. In some instances, the graphical canvas is configured to maintain its orientation with respect to at least one of a geomagnetic heading and/or the solid-state luminaire. In some cases, adjusting the light beam distribution of the solid-state luminaire includes at least one of: changing at least one of beam direction, beam angle, beam diameter, beam distribution, brightness, and/or color of light emitted by the solid-state luminaire; and/or producing at least one of a lighting pattern and/or a lighting sequence using the solid-state luminaire. In some instances, at least one of the selectable control features includes a network connection management feature configured to at least one of establish and/or refresh a network connection between the computing device and the solid-state luminaire. In some cases, at least one of the selectable control features includes a lighting pattern/sequence management feature configured to at least one of initiate, terminate, and/or adjust a lighting pattern/sequence produced using the solid-state luminaire. In some instances, the solid-state luminaire and the computing device are configured to be communicatively coupled with one another using at least one of an ArtNET digital multiplexer (DMX) interface protocol, a Wi-Fi protocol, a Bluetooth protocol, a digital addressable lighting interface (DALI) protocol, and/or a ZigBee protocol.

Another example embodiment provides a computer program product including a plurality of instructions non-transiently encoded thereon that, when executed by one or more processors, cause a process to be carried out. The computer program product may include one or more computer-readable mediums, such as, for example, a hard drive, compact disk, memory stick, server, cache memory, register memory, random-access memory (RAM), read-only memory (ROM), flash memory, or any suitable non-transitory memory that is encoded with instructions that can be executed by one or more processors, or a plurality or combination of such memories. The process includes: presenting a field of selectable control features on a computing device configured to communicatively couple with a solid-state luminaire, wherein at least one of the selectable control features is presented as a graphical canvas including one or more selectable nodes corresponding to one or more light sources of the solid-state luminaire; and adjusting the light beam distribution of the solid-state luminaire based on a selection of one or the one or more selectable nodes. In some cases, the computing device includes at least one of a laptop/notebook computer, a tablet computer, a mobile phone, a smartphone, a personal digital assistant (PDA), a portable media player (PMP), a cellular handset, a handheld gaming device, a gaming platform, a desktop computer, and/or a television set. In some instances, the computing device includes a touch-sensitive display on which the field of selectable control features is presented as one or more light-based icons. In some cases, selection of a selectable node of the graphical canvas toggles a corresponding one or more light sources of the solid-state luminaire on/off. In some instances, the graphical canvas is configured to maintain its orientation with respect to at least one of a geomagnetic heading and/or the solid-state luminaire. In some cases, adjusting the light beam distribution of the solid-state luminaire includes at least one of: changing at least one of beam direction, beam angle, beam diameter, beam distribution, brightness, and/or color of light emitted by the solid-state luminaire; and/or producing at least one of a lighting pattern and/or a lighting sequence using the solid-state luminaire. In some instances, at least one of the selectable control features includes a network connection management feature configured to at least one of establish and/or refresh a network connection between the computing device and the solid-state luminaire. In some cases, at least one of the selectable control features includes a lighting pattern/sequence management feature configured to at least one of initiate, terminate, and/or adjust a lighting pattern/sequence produced using the solid-state luminaire. In some instances, the solid-state luminaire and the computing device are configured to be communicatively coupled with one another using at least one of an ArtNET digital multiplexer (DMX) interface protocol, a Wi-Fi protocol, a Bluetooth protocol, a digital addressable lighting interface (DALI) protocol, and/or a ZigBee protocol.

Another example embodiment provides a graphical user interface (GUI) on a computing system, the GUI including: a field of selectable control features configured such that selection therefrom electronically controls a light beam distribution of a solid-state luminaire communicatively coupleable with the computing system; wherein at least one of the selectable control features is presented as a graphical canvas including one or more selectable nodes corresponding to one or more light sources of the solid-state luminaire; and wherein selection of a selectable node of the graphical canvas toggles a corresponding one or more of the light sources of the solid-state luminaire on/off. In some cases, the computing device includes at least one of a laptop/notebook computer, a tablet computer, a mobile phone, a smartphone, a personal digital assistant (PDA), a portable media player (PMP), a cellular handset, a handheld gaming device, a gaming platform, a desktop computer, and/or a television set. In some instances, the computing device includes a touch-sensitive display on which the field of selectable control features is presented as one or more light-based icons. In some cases, the graphical canvas is configured to maintain its orientation with respect to at least one of a geomagnetic heading and/or the solid-state luminaire. In some instances, electronic control of the light beam distribution of the solid-state luminaire includes at least one of: changing at least one of beam direction, beam angle, beam diameter, beam distribution, brightness, and/or color of light emitted by the solid-state luminaire; and/or producing at least one of a lighting pattern and/or a lighting sequence using the solid-state luminaire.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A method of electronically controlling a light beam distribution of a solid-state luminaire, the method comprising:

presenting a field of selectable control features on a computing device, wherein the solid-state luminaire is communicatively connected to the computing device, and at least one of the field of selectable control features is presented as a graphical canvas resembling a target region to be lighted by one or more light sources of the solid-state luminaire, one or more selectable nodes of the graphical canvas corresponding to the one or more light sources of the solid-state luminaire, and a circular cursor node of the graphical canvas depicting a distribution of the light beam provided by the solid-state luminaire; and adjusting the light beam distribution of the solid-state luminaire based on the size or location of the circular cursor on a selection of one of the one or more selectable nodes presented on the graphical canvas.

2. The method of claim 1, wherein the computing device comprises at least one of a laptop/notebook computer, a tablet computer, a mobile phone, a smartphone, a personal digital assistant (PDA), a portable media player (PMP), a cellular handset, a handheld gaming device, a gaming platform, a desktop computer, and/or a television set.

3. The method of claim 1, wherein the computing device includes a touch-sensitive display on which the field of selectable control features is presented as one or more light-based icons.

4. The method of claim 1, wherein selection of a selectable node of the graphical canvas toggles a corresponding one or more light sources of the solid-state luminaire on/off.

5. The method of claim 1, wherein the graphical canvas is configured to maintain its orientation with respect to at least one of a geomagnetic heading and/or the solid-state luminaire.

6. The method of claim 1, wherein adjusting the light beam distribution of the solid-state luminaire comprises at least one of:

changing at least one of beam direction, beam angle, beam diameter, beam distribution, brightness, and/or color of light emitted by the solid-state luminaire; and/or producing at least one of a lighting pattern and/or a lighting sequence using the solid-state luminaire.

7. The method of claim 1, wherein at least one of the selectable control features comprises a network connection management feature configured to at least one of establish and/or refresh a network connection between the computing device and the solid-state luminaire.

8. The method of claim 1, wherein at least one of the selectable control features comprises a lighting pattern/sequence management feature configured to at least one of initiate, terminate, and/or adjust a lighting pattern/sequence produced using the solid-state luminaire.

9. The method of claim 1, wherein the solid-state luminaire and the computing device are configured to be communicatively coupled with one another using at least one of an ArtNET digital multiplexer (DMX) interface protocol, a Wi-Fi protocol, a Bluetooth protocol, a digital addressable lighting interface (DALI) protocol, and/or a ZigBee protocol.

10. A non-transient computer program product encoded with instructions that, when executed by one or more processors, causes a process to be carried out, the process comprising:

presenting a field of selectable control features on a computing device, wherein a solid-state luminaire is communicatively connected to the computing device, and at least one of the selectable control features is presented as a graphical canvas of an image of the region to be illuminated by one or more light sources of the solid-state luminaire, one or more selectable nodes of the graphical canvas corresponding to the one or more light sources of the solid-state luminaire, and a circular cursor of the graphical canvas depicting a distribution of the light beam provided by the solid-state luminaire; and adjusting the light beam distribution of the solid-state luminaire based on the size or location of the circular cursor on a selection of one or the one or more selectable nodes presented on the graphical canvas.

11. The non-transient computer program product of claim 10, wherein the computing device comprises at least one of a laptop/notebook computer, a tablet computer, a mobile phone, a smartphone, a personal digital assistant (PDA), a portable media player (PMP), a cellular handset, a handheld gaming device, a gaming platform, a desktop computer, and/or a television set.

12. The non-transient computer program product of claim 10, wherein the computing device includes a touch-sensitive display on which the field of selectable control features is presented as one or more light-based icons.

13. The non-transient computer program product of claim 10, wherein selection of a selectable node of the graphical canvas toggles a corresponding one or more light sources of the solid-state luminaire on/off.

14. The non-transient computer program product of claim 10, wherein the graphical canvas is configured to maintain its orientation with respect to at least one of a geomagnetic heading and/or the solid-state luminaire.

15. The non-transient computer program product of claim 10, wherein adjusting the light beam distribution of the solid-state luminaire comprises at least one of:

changing at least one of beam direction, beam angle, beam diameter, beam distribution, brightness, and/or color of light emitted by the solid-state luminaire; and/or producing at least one of a lighting pattern and/or a lighting sequence using the solid-state luminaire.

16. The non-transient computer program product of claim 10, wherein at least one of the selectable control features comprises a network connection management feature configured to at least one of establish and/or refresh a network connection between the computing device and the solid-state luminaire.

17. The non-transient computer program product of claim 10, wherein at least one of the selectable control features comprises a lighting pattern/sequence management feature configured to at least one of initiate, terminate, and/or adjust a lighting pattern/sequence produced using the solid-state luminaire.

18. The non-transient computer program product of claim 10, wherein the solid-state luminaire and the computing device are configured to be communicatively coupled with one another using at least one of an ArtNET digital multiplexer (DMX) interface protocol, a Wi-Fi protocol, a Bluetooth protocol, a digital addressable lighting interface (DALI) protocol, and/or a ZigBee protocol.

19. A graphical user interface (GUI) on a computing system, the GUI comprising:

a field of selectable control features configured such that selection therefrom electronically controls a light beam distribution of a solid-state luminaire communicatively connected to the computing system;

wherein at least one of the selectable control features is presented as a graphical canvas on the GUI resembling a target region to be lighted by one or more light sources of the solids-state luminaire, one or more selectable nodes of the graphical canvas corresponding to the one or more light sources of the solid-state luminaire, and a circular cursor of the graphical canvas depicting a distribution of the light beam provided by the solid-state luminaire; and wherein selection of a selectable node of the graphical canvas toggles a corresponding one or more of the light sources of the solid-state luminaire on/off based on the size or location of the circular cursor on a selection of one of the one or more selectable nodes presented on the graphical canvas; and wherein the graphical canvas is configured to maintain its orientation with respect to at least one of a geomagnetic heading and/or the solid-state luminaire.

20. The GUI of claim 19, wherein the computing device comprises at least one of a laptop/notebook computer, a tablet computer, a mobile phone, a smartphone, a personal digital assistant (PDA), a portable media player (PMP), a cellular handset, a handheld gaming device, a gaming platform, a desktop computer, and/or a television set.

21. The GUI of claim 19, wherein the computing device includes a touch-sensitive display on which the field of selectable control features is presented as one or more light-based icons.

22. The GUI of claim 19, wherein electronic control of the light beam distribution of the solid-state luminaire comprises at least one of:

changing at least one of beam direction, beam angle, beam diameter, beam distribution, brightness, and/or color of light emitted by the solid-state luminaire; and/or producing at least one of a lighting pattern and/or a lighting sequence using the solid-state luminaire.

* * * * *